United States Patent [19]

Tanaka et al.

[11] Patent Number: 4,469,785

[45] Date of Patent: Sep. 4, 1984

[54] LIGHT-SENSITIVE SILVER HALIDE COLOR PHOTOGRAPHIC MATERIAL

[75] Inventors: Shigeo Tanaka; Kaoru Onodera, both of Odawara; Noboru Fujimori, Hino, all of Japan

[73] Assignee: Konishiroku Photo Industry Co., Ltd., Tokyo, Japan

[21] Appl. No.: 448,787

[22] Filed: Dec. 10, 1982

[30] Foreign Application Priority Data

Dec. 19, 1981 [JP] Japan ..... 56-205521
Dec. 21, 1981 [JP] Japan ..... 56-207592
Dec. 21, 1981 [JP] Japan ..... 56-207593

[51] Int. Cl.[3] ..... G03C 1/02

[52] U.S. Cl. ..... 430/572; 430/570; 430/574; 430/577; 430/591; 430/505; 430/550

[58] Field of Search ..... 430/574, 577, 572, 591, 430/550, 505

[56] References Cited

U.S. PATENT DOCUMENTS 2,977,229 3/1961 Jones ..... 430/577
3,615,517 10/1971 Milton et al. ..... 430/410
3,703,377 11/1972 Sakazume et al. ..... 430/592
3,881,936 5/1975 Hayakawa et al. ..... 430/577
3,976,492 8/1976 Hinata et al. ..... 430/574
3,985,563 10/1976 Hinata et al. ..... 430/574
3,986,878 10/1976 Hinata et al. ..... 430/574
3,988,155 10/1976 Hinata et al. ..... 430/574
4,173,483 11/1979 Habu et al. ..... 430/577

*Primary Examiner*—J. Travis Brown
*Attorney, Agent, or Firm*—Frishauf, Holtz, Goodman & Woodward

[57] ABSTRACT

There is disclosed a light-sensitive silver halide color photographic material having a silver halide emulsion layer containing at least one layer of a negative working silver halide on a support, comprising the negative working silver halide comprises at least 80 mole % of silver chloride, and being color sensitized with at least one kind of sensitizing dyes having the local maximum value of spectral sensitivity in the wavelength region from 445 nm to 490 nm and at least one kind of sensitizing dyes having the local maximum value of spectral sensitivity in the wavelength region from 420 nm to less than 445 nm.

The photographic material according to this invention exhibits excellent color reproducibility and quick process suitability.

17 Claims, No Drawings

LIGHT-SENSITIVE SILVER HALIDE COLOR PHOTOGRAPHIC MATERIAL

This invention relates to a light-sensitive silver halide color photographic material (abbreviated hereinafter merely as light-sensitive photographic material) by use of a higher chloride silver halide emulsion spectrally sensitized, particularly with a combination of two or more kinds of sensitizing dyes. More particularly, it pertains to a light-sensitive photographic material by use of a higher chloride silver halide emulsion spectrally sensitized with a combination of two or more kinds of dyes at a wavelength region of blue light (about 400~500 nm).

The "higher chloride silver halide emulsion" herein used means an emulsion in which the silver halide comprises 80 mol % or more of silver chloride.

Heretofore, a silver halide emulsion composed mainly of silver bromide has been used for a light-sensitive silver halide color photographic material, because relatively higher sensitivity can be obtained with ease. However, a higher chloride silver halide emulsion is known to be capable of more quick process, as compared with such a silver halide emulsion composed mainly of silver bromide. Among the several reasons which can be contemplated, it may be possible to point out the higher solubility of a higher chloride silver halide emulsion. As another advantage, because of substantially no absorption of visible light by silver chloride, it is not necessary to contrive to enlarge the difference between the blue sensitivity of a green-sensitive emulsion and a red-sensitive emulsion and the blue sensitivity of a blue-sensitive emulsion, which has hitherto been practiced when a higher chloride silver halide is provided for use in a light-sensitive photographic material. This enables elimination of the filter layer in a light-sensitive photographic material in which the blue sensitivity of a green-sensitive emulsion and a red-sensitive emulsion has been lowered with a yellow filter layer, also enabling elimination of colloidal silver which has caused such problems as formation of fog in adjacent emulsion layers, etc. Also, in some light-sensitive photographic materials, there has been created a difference betwen the blue sensitivity of a green-sensitive emulsion and a red-sensitive emulsion and the blue sensitivity of a blue-sensitive emulsion by using silver halide grains with large grain sizes as the blue photosensitive emulsion layer. No requirement of such a measure will alleviate the drawbacks such as tendency to fog or lowering in developing rate caused by such large grain sizes. In recent years, there is an increasing tendency to desire for quick process of light-sensitive photographic materials, and realization of a light-sensitive photographic material by use of a higher chloride silver halide emulsion having such advantages has earnestly been longed for. However, while having such advantages on one hand, the specific feature of silver chloride to absorb no visible light is on the other hand very disadvantageous for application in a blue-sensitive emulsion. In addition, it proved to be also poor in storage stability. As hampered by these drawbacks, there has been reported no successful practical application.

Because silver halide absorbs no visible light, it is clearly necessary to use essentially a spectral sensitization even when it is used as a blue-sensitive emulsion layer. However, in light-sensitive photographic materials to be used for photographing, no good color reproduction can be expected in finally obtained images, unless they have a spectral sensitivity distribution having good corresponding relation with the visual characteristics of a man. On the other hand, light-sensitive materials to be used for printing must have an appropriate spectral sensitivity distribution capable of receiving accurately the information recorded in the light-sensitive materials to be used for photographing. To mention about the case of employing the presently available color negative film and color photographic paper, if in this system overlapping between the spectral absorption of the yellow dye in the color negative film and the spectral sensitivity distribution of the blue-sensitive emulsion in the color photographic paper is small, the final image will be an image of a markedly low contrast, which is deficient in yellow tincture. And, when a color correction filter is used as a means for compensating for such a drawback, there may ensue problems in color reproduction such that a dense yellow portion may become yellow with a red tint, and a red portion may become red with a purple tint. This is a phenomenon which occurs due to the low effective blue sensitivity of the blue-sensitive emulsion in a color photographic paper, whereby the sensitivity at the shorter wavelength side of the green-sensitive emulsion layer cannot relatively be neglected. For printing on a color photographic paper, there have generally been used tungsten lamps as light source (recently, halogen lamps having sealed a halogen gas therein are more frequently employed), and the energy of the light from such a light source is distributed predominantly on the longer wavelength side. Such tendency is further pronounced by the color mask employed in the color negative film. Improvement of such a drawback by the spectral sensitive region to the longer wavelength side may be possible in principle. Only alleviation of the aforesaid drawback is practically possible according to such a method, but another problem ensues as the result of employment of such a method. This will appear as the problem in color reproduction such that green color is reproduced with blue tincture or dense yellow color cannot sufficiently be exhibited. This is a phenomenon caused because of ineffective action of correction by means of a color mask used in the color negative film. Thus, it is not an easy task to carry out simply spectral sensitization, but there is indeed involved a serious problem of a critically important balance of sensitivities within the corresponding wavelength region.

A number of spectral sensitization techniques in blue light region have been disclosed. For example, Japanese Patent Publication No. 19034/1970 discloses a technique employing a simple merocyanine dye or complex merocyanine dye having either one of benzothiazole nucleus or benzoxazole nucleus, and rhodanine nucleus. These dyes are characterized by having sulfoalkyl group or sulfoalkoxyalkyl group; Japanese Patent Publication No. 30023/1971 a technique employing a simple merocyanine dye having either one of nucleuses such as benzothiazole nucleus, benzoselenazole nucleus, benzoxazole nucleus, α-naphthothiazole nucleus, β-naphthothiozole nucleus, α-naphthoxazole nucleus, β-naphthoxazole nucleus, etc., and either one of nucleuses such as rhodanine nucleus, 2-thiooxazolidine-2,4-dione nucleas, thiohydantoin nucleus, etc. These dyes are characterized by having sulfoalkyl group, sulfoaralkyl group; Japanese Provisional Patent Publication No. 78930/1973 a technique employing a simple cyanine dye having two nucleuses selected from pyrroline nucleus, thiazoline nucleus, thiazole nucleus, benzothiazole nucleus, naphthothiazole nucleus, selenazole nucleus, benzoselenazole nucleus, naphthoselenazole nucleus, oxazole nucleus, benzoxazole nucleus, naphthoxazole nucleus, imidazole nucleus, benzimidazole nucleus, pyridine nucleus and quinoline nucleus, characterized by having sulfoalkyl group, 2-(2-sulfoethoxy)ethyl group, 2-(2-hydroxy-3-sulfopropoxy)ethyl group. However, these techniques of the prior art concern silver halide emulsions composed mainly of silver bromide. In the spectral sensitization technique at a region of blue light concerning a silver halide emulsion composed mainly of silver bromide, when only the intrinsic sensitivity region of silver halide is made the spectral sensitivity region for a blue photosensitive emulsion, spectral absorption of silver halide is preponderantly toward the side of ultra-violet region and therefore fails to correspond to the spectral absorption of a yellow dye. Consequently, color reproduction of yellow dye was disadvantageously poor. Said techniques of the prior art are intended for improvement of such a drawback. For this purpose, David L. Mac Adam proposes to provide an absorption on the longer wavelength region by sensitization of a blue-sensitive emulsion, as described in "Color Science and Color Photography (Physics Today, Vol. 20, pp. 27~39 (1967))".

However, because silver halide emulsion primarily constituted of silver chloride has scarcely spectral absorption at visible light region, when such a technique is simply applied for a higher chloride silver halide emulsion, there is an increase of deviation between the spectral characteristics of a yellow dye at the relatively shorter wavelength region (at a wavelength region shorter than 445 nm) and the spectral sensitivity distribution of a blue-sensitive emulsion layer, whereby only unsatisfactory result can be obtained.

Thus, when employing a higher chloride silver halide emulsion as a blue-sensitive emulsion, application of a technique to impart sufficiently a spectral sensitivity in the wavelength region shorter than 445 nm has been desired. However, excellent characteristics of a higher chloride silver halide emulsion as described above can never be exhibited only by imparting a sensitivity to said wavelength region to be well balanced with the sensitivity at the longer wavelength region. Due to lower sensitivity of silver chloride, sensitivity over the whole blue light region is further required to be enhanced.

Employment of a combination of two or more kinds of sensitizing dyes is generally practiced by those skilled in the art. When two or more kinds of sensitizing dyes are used in combination, the spectral sensitivity obtained will be in most cases the intermediate effect between those of the dyes individually employed or rather lowered, but by use of a specific combination of sensitizing dyes of different types, marked enhancement of spectral sensitivity may sometimes be effected than when respective dyes are individually employed. Usually, this phenomenon is called as super sensitization. Thus, by using in combination sensitizing dyes, higher spectral sensitivity can be obtained than when respective sensitizing dyes are used individually, and it has been a great task in the spectral sensitizing technique for silver halide photographic emulsion to find out a combination of sensitizing dyes which can provide a sensitizing wavelength region suited for the purpose of use of a light-sensitive photographic material.

There have been also disclosed some combinations of sensitizing dyes in the blue light region. For example, Japanese Provisional Patent Publication No. 14019/1976 discloses a combination of a simple cyanine dye having two nuclei selected from thiazole nucleus (for the purpose of showing whether benzene ring is fused or not, the term "non-fused thiazole nucleus" used for representation of thiazole nucleus, and the term "fused thiazole nucleus" for representing at the same time both of benzothiazole nucleus and naphthothiazole nucleus; similar terminologies being also applied for selenazole nucleus, oxazole nucleus, etc.), benzothiazole nucleus, benzoselenazole nucleus, with a simple cyanine dye having either one nucleus of naphthothiazole nucleus and naphthoselenazole nucleus and one nucleus selected from fused or non-fused thiazole nucleus, fused selenazole nucleus; Japanese Provisional Patent Publication No. 29128/1976 a combination of a simple cyanine dye having one nucleus selected from fused or non-fused thiazole nucleus, fused or non-fused selenazole nucleus and either one nucleus of naphthothiazole nucleus and naphthoselenazole nucleus with a simple cyanine dye having one nucleus selected from fused or non-fused thiazole nucleus, fused or non-fused selenazole nucleus and one nucleus selected from fused or non-fused imidazole nucleus; and Japanese Provisional Patent Publication No. 30724/1976 a combination of a simple cyanine dye having one nucleus selected from fused or non-fused thiazole nucleus, fused or non-fused selenazole nucleus and one nucleus selected from fused or non-fused imidazole nucleus with a simple cyanine dye having either one nucleus of pyridine nucleus, quinoline nucleus and one nucleus selected from fused or non-fused imidazole, fused or non-fused oxazole nucleus.

However, these techniques also concern emulsions composed mainly of silver bromide similarly as those techniques previously mentioned, and no satisfactory result with respect to spectral sensitivity could be obtained by application of these techniques for higher chloride silver halide emulsions.

Also, sensitizing dyes are known to have influence on the progress of development and, in order to be adapted for quick process, a sensitizing dye having no development inhibiting characteristic is desirable. Further, sensitizing dyes are known to frequently remain in light-sensitive materials after photographic process, thereby causing stain, and in order to be adapted for quick process, more severe restriction than before has been imposed with this respect.

As described above, when a higher chloride silver halide emulsion is to be used as a blue-sensitive emulsion, no simple application of the prior art is insufficient, but it is required to be endowed sufficiently with a sensitivity at a wavelength region shorter than 445 nm. Accordingly, it has been longed for to develop a spectral sensitizing technique employing a combination of sensitizing dyes, which can give a preferable spectral sensitivity distribution when applied for a higher chloride silver halide emulsion, also with increase of the sensitivity over the whole blue light region, and can improve the color reproduction, while also satisfying the more severe requirements than before with respect to development inhibition or stain.

The first object of this invention is to provide a light-sensitive photographic material which is capable of affording quick processs and improved in color reproducibility. The second object of this invention is to provide a color photographic paper which is capable of affording quick process and improved in color reproducibility.

It has now been found by the extensive studies made by the present inventors that the aforesaid objects can be accomplished by use of a light-sensitive silver halide color photographic material having a silver halide emulsion layer containing at least one layer of a negative working silver halide on a support, in which said negative working silver halide comprises at least 80 mole % of silver chloride, being spectral sensitized with at least one kind of sensitizing dyes having the local maximum value of spectral sensitivity in the wavelength region from 445 nm to 490 nm and at least one kind of sensitizing dyes having the local maximum value of spectral sensitivity in the wavelength region from 420 nm to less than 445 nm.

The specific feature of this invention resides in the use of at least one kind of sensitizing dyes having the local maximum value of spectral sensitivity in the wavelength region from 445 nm to 490 nm (this is hereinafter referred to as longer wavelength dye), and the use of at least one kind of sensitizing dyes having the local maximum value of spectral sensitivity in the wavelength region from 420 nm to less than 445 nm (this is hereinafter referred to as shorter wavelength dye), and the use of an emulsion comprising 80 mole % of silver chloride as the negative working silver halide emulsion.

As the longer wavelength dye [I] according to this invention, there may be preferably employed a compound having any kind of structure, so long as it has the local maximum value of spectral sensitivity in the wavelength region from 445 nm to 490 nm. Particularly preferred are the compounds as enumerated below, but this invention is not limited to these dyes.

(I-1)

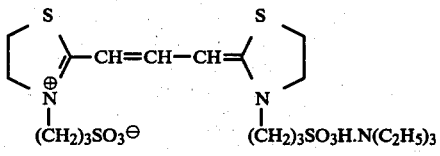

(I-2)

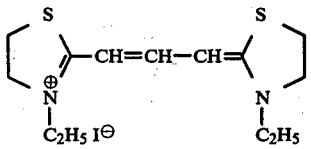

(I-3)

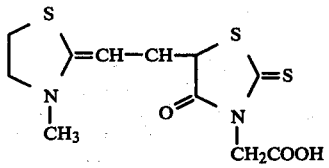

-continued (I-4)

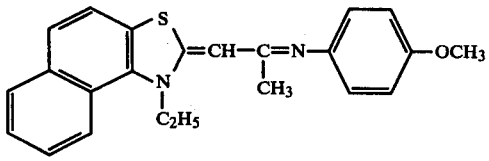

(I-5)

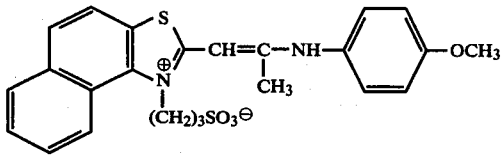

(I-6)

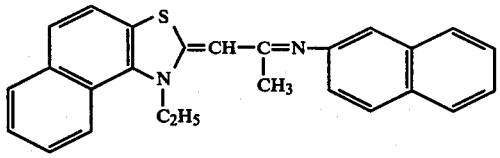

(I-7)

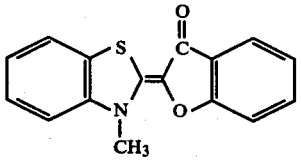

(I-8)

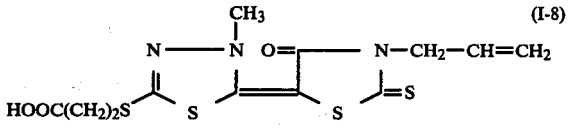

(I-9)

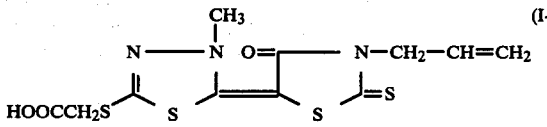

(I-10)

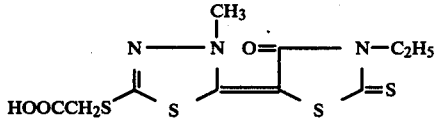

(I-11)

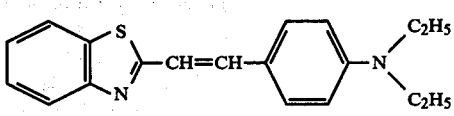

As the shorter wavelength dye [II] according to this invention, there may be preferably employed a compound having any kind of structure, so long as it is a sensitizing dye having the local maximum value of spectral sensitivity in the wavelength region from 420 nm to less than 445 nm. Particularly preferred are the compounds as enumerated below, but this invention is not limited to these dyes.

(II-1)

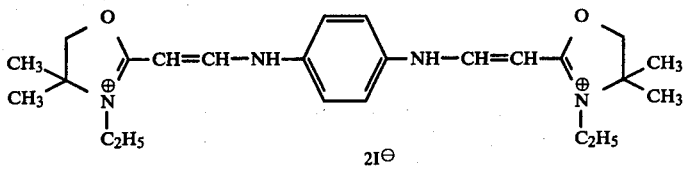

-continued (II-2)

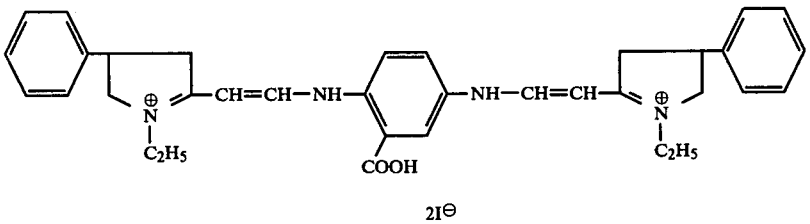

(II-3)

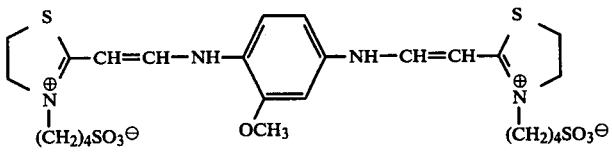

(II-4)

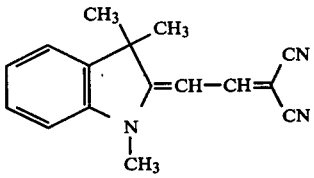

(II-5)

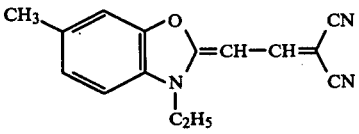

(II-6)

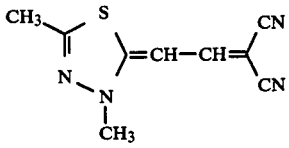

(II-7)

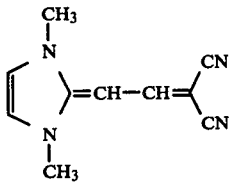

Further, this invention may be employed a combination of at least one kind of the longer wavelength dyes represented by the following formula [III] or [IV] and at least one kind of the shorter wavelength dyes represented by the following formula [V] or [VI].

Formula [III]

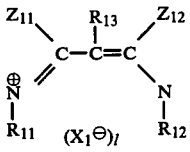

wherein $Z_{11}$ and $Z_{12}$ represent individually atoms necessary for formation of a benzoxazole nucleus, a naphthoxazole nucleus, a benzothiazole nucleus, a naphthothiazole nucleus, a benzoselenazole nucleus, a naphthoselenazole nucleus, a benzimidazole nucleus, a naphthoimidazole nucleus, a pyridine nucleus or a quinoline nucleus; $R_{11}$ and $R_{12}$ represent individually a group selected from an alkyl group, an alkenyl group or an aryl group; $R_{13}$ represents a hydrogen atom, a methyl group or an ethyl group; $X_1\ominus$ represents an anion; and l represents 0 or 1.

Formula [IV]

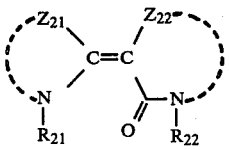

wherein $Z_{21}$ represents atoms necessary for formation of a benzoxazole nucleus, a naphthoxazole nucleus, a benzothiazole nucleus, a naphthothiazole nucleus, a benzoselenazole nucleus, a naphthoselenazole nucleus, a benzimidazole nucleus or a naphthoimidazole nucleus; $Z_{22}$ represents atoms necessary for formation of a rhodanine nucleus, a 2-thiohydantoin nucleus or a 2-thioselenazolidine-2,4-dione nucleus; $R_{21}$ and $R_{22}$ represent individually an alkyl group, an alkenyl group or an aryl group.

Formula [V]

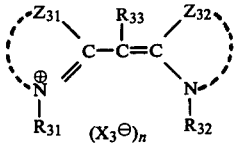

wherein $Z_{31}$ and $Z_{32}$ represent individually atoms necessary for formation of a cyanine heterocyclic nucleus selected from the group A and the group B (both may be selected from the group A, but both are not selected exclusively from the group B); $R_{31}$ and $R_{32}$ represent individually an alkyl group, an alkenyl group or an aryl group; $R_{33}$ represents a hydrogen atom, a methyl group or an ethyl group; $X_1\ominus$ represents an anion; and n represents 0 or 1:

[Group A]: imidazole nucleus, oxazole nucleus, thiazole nucleus, selenazole nucleus, indole nucleus;

[Group B]: benzimidazole nucleus, naphthoimidazole nucleus, benzoxazole nucleus, naphthoxazole nucleus, benzothiazole nucleus, naphthothiazole nucleus, benzoselenazole nucleus, naphthoselenazole nucleus, pyridine nucleus, quinoline nucleus.

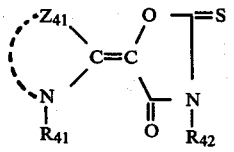

Formula [VI]

wherein $Z_{41}$ represents atoms necessary for formation of a benzothiazole nucleus, a naphthothiazole nucleus, a benzoselenazole nucleus or a naphthoselenazole nucleus; and $R_{41}$ and $R_{42}$ represent individually an alkyl group, an alkenyl group or an aryl group.

Among the compounds represented by the formula [III], those represented by the following formula [III-a] may more preferably be used; while among the compounds represented by the formula [IV], those represented by the following formula [IV-a]; and among the compounds represented by the formula [V], those represented by the following formula [V-a]; further among the compounds represented by the formula [VI], those represented by the following formula [VI-a].

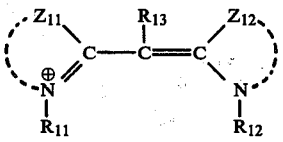

Formula [III-a]

$(X_1^{\ominus})_l$

In the above formula, $Z_{11}$ and $Z_{12}$ represent each independently atoms necessary for formation of a benzoxazole nucleus, a naphthoxazole nucleus, a benzothiazole nucleus, a naphthothiazole nucleus, a benzoselenazole nucleus, a naphthoselenazole nucleus, a pyridine nucleus, a quinoline nucleus, a benzimidazole nucleus, or a naphthoimidazole nucleus.

$R_{11}$ and $R_{12}$ represent each independently an alkyl group, an alkenyl group or an aryl group, preferably an alkyl group, more preferably an alkyl group substituted with a carboxyl group or a sulfo group, most preferably a sulfoalkyl group having 1 to 4 carbon atoms. $R_{13}$ is selected from a hydrogen atom, a methyl group or an ethyl group. $X_1^{\ominus}$ represents an anion; and l represents 0 or 1.

$Z_{11}$ and $Z_{12}$ amy be each substituted with various substituents, and preferable substituents may include a halogen atom, a hydroxyl group, a cyano group, an aryl group, an alkyl group, an alkoxyl group or an alkoxycarbonyl group. More preferably, the substituents may be a halogen atom, a cyano group, an aryl group, an alkyl group or an alkoxy group having 1 to 6 carbon atoms, most preferably a halogen atom, a cyano group, a methyl group, an ethyl group, a methoxy group or an ethoxy group.

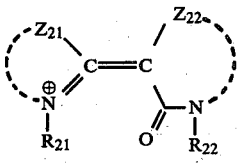

Formula [IV-a]

In the above formula, $Z_{21}$ represents atoms necessary for formation of a benzoxazole nucleus, a naphthoxazole nucleus, a benzothiazole nucleus, a naphthothiazole nucleus, a benzoselenazole nucleus, a naphthoselenazole nucleus, a benzimidazole nucleus or a naphthoimidazole nucleus. $Z_{21}$ may be substituted with various substituents, and preferable substituents may include a halogen atom, a hydroxyl group, a cyano group, an aryl group, an alkyl group, an alkoxyl group or an alkoxy-carbonyl group. More preferably, the substituents may be a halogen atom, a cyano group, an aryl group, an alkyl group (e.g., a methyl group, an ethyl group) or an alkoxyl group (e.g., a methoxy group or an ethoxy group) having 1 to 6 carbon atoms.

$Z_{22}$ represents atoms necessary for formation of a rhodanine nucleus, a 2-thiohydantoin nucleus or a 2-thioselenazolidine-2,4-dione nucleus. In case of a 2-thiohydantoin nucleus, the nitrogen atom at the 1-position may be substituted, preferably with an alkyl group, a hydroxyalkyl group or an alkoxycarbonyl group.

$R_{21}$ and $R_{22}$ represent individually an alkyl group an alkenyl group or an aryl group. Preferable substituents are an alkyl group and an aryl group, more preferably an alkyl group having 1 to 4 carbon atoms, a sulfoalkyl group, a carboxyalkyl group, an aralkyl group (e.g., a benzyl group), an alkoxyalkyl group (e.g., a 2-methoxyethyl group, a 3-methoxypropyl group) or an alkoxycarbonylalkyl group (e.g., a methoxycarbonylpropyl group). Most preferably, the substituent may be an alkyl group having 1 to 4 carbon atoms, a sulfoalkyl group or a benzyl group, and the case in which one substituent is a sulfoalkyl group and the other is an alkyl group is the most preferred.

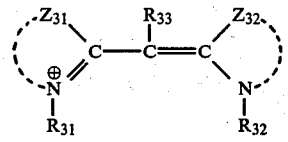

Formula [V-a]

$(X_3^{\ominus})_n$

In the above formula, $Z_{31}$ and $Z_{32}$ represent each independently atoms necessary for formation of a cyanine heterocyclic nucleus selected from the group A and the group B. Here, both may be selected from the group A, but both are not selected exclusively from the group B.

[Group A]: imidazole nucleus, oxazole nucleus, thiazole nucleus, selenazole nucleus, indole nucleus;

[Group B]: benzimidazole nucleus, napthoimidazole nucleus, benzoxazole nucleus, naphthoxazole nucleus, benzothiazole nucleus, naphthothiazole nucleus, benzoselenazole nucleus, naphthoselenazole nucleus, pyridine nucleus, quinoline nucleus.

$R_{31}$ and $R_{32}$ represent each independently an alkyl group, an alkenyl group or an aryl group, preferably an alkyl group, more preferably an alkyl group substituted with a carboxyl group or a sulfo group, most preferably a sulfoalkyl group having 1 to 4 carbon atoms.

$R_{33}$ is selected from a hydrogen atom, a methyl group or an ethyl group. $X_3^{\ominus}$ represents an anion; and n represents 0 or 1.

$Z_{31}$ and $Z_{32}$ may be each substituted with various substituents, and preferable substituents may include a halogen atom, a hydroxyl group, a cyano group, an aryl group, an alkyl group, an alkoxyl group or an alkoxycarbonyl group. More preferably, the substituents may be a halogen atom, a cyano group, an aryl group, an alkyl group or an alkoxyl group having 1 to 6 carbon atoms, most preferably a halogen atom, a cyano group, a methyl group, an ethyl group, a methoxy group or an ethoxy group.

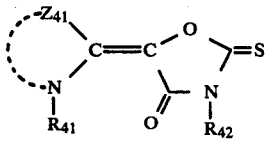

Formula [VI-a]

In the above formula, $Z_{41}$ represents atoms necessary for formation of a benzothiazole nucleus, a naphthothiazole nucleus, a benzoselenazole nucleus or a naphthoselenazole nucleus. $Z_{41}$ may be substituted with various substituents, and preferable substituents may include a halogen atom, a hydroxyl group, a cyano group, an aryl group, an alkyl group, an alkoxyl group or an alkoxycarbonyl group. More preferably, the substituents may be a halogen atom, a cyano group, an aryl group, an alkyl group (e.g., a methyl group, an ethyl group) or an alkoxyl group (e.g., a methoxy group or an ethoxy group) having 1 to 6 carbon atoms.

$R_{41}$ and $R_{42}$ represent individually an alkyl group, an alkenyl group or an aryl group. Preferable substituents are an alkyl group and an aryl group, more preferably an alkyl group having 1 to 4 carbon atoms, a sulfoalkyl group, a carboxyalkyl group, an aralkyl group (e.g., a benzyl group), an alkoxyalkyl group (e.g., a 2-methoxyethyl group, a 3-methoxypropyl group) or an alkoxycarbonylalkyl group (e.g., a methoxycarbonylpropyl group). Most preferably, the substituents may be an alkyl group having 1 to 4 carbon atoms, a sulfoalkyl group or a benzyl group, and the case in which one substituent is a sulfoalkyl group and the other is an alkyl group is the most preferred.

Further, among the sensitizing dyes represented by the formula [III-a] in this invention, more preferable sensitizing dyes are those represented by the formula [III-b]:

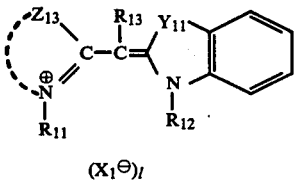

Formula [III-b]

In the above formula, $Z_{13}$ represents atoms necessary for formation of a benzothiazole nucleus, a benzoselenazole nucleus, a naphthothiazole nucleus or a naphthoselenazole nucleus. $Y_{11}$ represents a sulfur atom or a selenium atom, when $Z_{13}$ forms a benzothiazole nucleus or a benzoselenazole nucleus; while it represents a sulfur atom, a selenium atom, an oxygen atom or a nitrogen atom, when $Z_{13}$ forms a naphthothiazole nucleus or a naphthoselenazole nucleus.

The two cyanine heterocyclic nuclei may be substituted with the substituents as shown for the formula [III-a]. $R_{11}$, $R_{12}$, $R_{13}$, $X_1\ominus$ and l are the same as shown for the formula [III-a].

Among the sensitizing dyes represented by the formula [III-b] according to this invention, particularly useful sensitizing dye are those represented by the formula [III-c]:

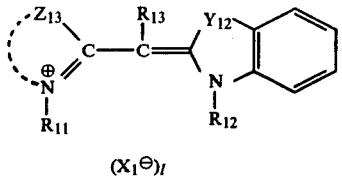

Formula [III-c]

In the above formula, $Z_{13}$ represents atoms necessary for formation of a benzothiazole nucleus, a benzoselenazole nucleus, a naphthothiazole nucleus or a naphthoselenazole nucleus. $Y_{12}$ represents a sulfur atom or a selenium atom.

The two cyanine heterocyclic nuclei may be substituted with the substituents as shown for the formula [III-a]. $R_{11}$, $R_{12}$, $R_{13}$, $X_1\ominus$ and l are the same as shown for the formula [III-a].

Among the sensitizing dyes represented by the formula [III-c], particularly useful sensitizing dyes are those represented by the formula [III-d]:

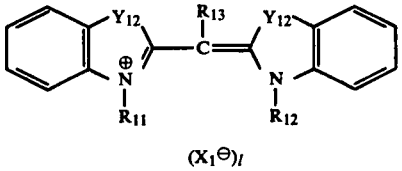

Formula [III-d]

In the above formula, $Y_{12}$ represents a sulfur atom or a selenium atom.

The two cyanine heterocyclic nuclei may be substituted with the substituents as shown for the formula [III-a]. $R_{11}$, $R_{12}$, $R_{13}$, $X_1\ominus$ and l are the same as shown for the formula [III-a].

Among the sensitizing dyes represented by the formula [IV-a], those which are particularly useful are represented by the formula [IV-b]:

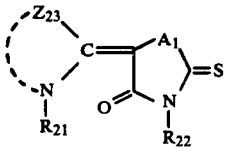

Formula [IV-b]

In the above formula, $Z_{23}$ represents atoms necessary for formation of a benzoxazole nucleus, a benzothiazole nucleus, a benzoselenazole nucleus, a naphthoxazole nucleus, a naphthothiazole nucleus or a naphthoselenazole nucleus. $A_1$ represents a sulfur atom or a selenium atom, when $Z_{23}$ forms a benzoxazole nucleus, a benzothiazole nucleus or a benzoselenazole nucleus; while it represents a sulfur atom, a selenium atom or a nitrogen atom, when $Z_{23}$ forms a naphthoxazole nucleus, a naphthothiazole nucleus or a naphthoselenazole nucleus. The nitrogen atom may be substituted with a substituent as shown for the formula [IV-a]. $R_{21}$ and $R_{22}$ are the same as shown for the formula [IV-a].

Among the sensitizing dyes represented by the formula [IV-b], particularly preferable sensitizing dyes are those represented by the formula [IV-c]:

Formula [IV-c]

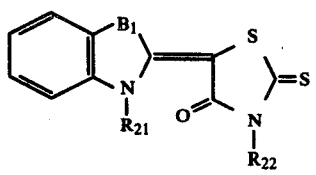

In the above formula, $B_1$ represents an oxygen atom, a sulfur atom or a selenium atom. The cyanine heterocyclic nucleus may be substituted with the substituents as shown for the formula [IV-a]. $R_{21}$ and $R_{22}$ are the same as those described for the formula [IV-a].

Among the sensitizing dyes represented by the formula [V-a], those which are particularly useful are represented by the formula [V-b]:

Formula [V-b]

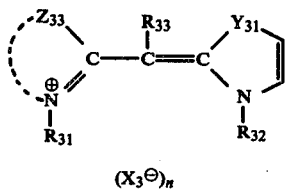

In the above formula, $Z_{33}$ represents atoms necessary for formation of a benzoxazole nucleus, a naphthoxazole nucleus, a benzothiazole nucleus, a naphthothiazole nucleus, a benzoselenazole nucleus, a naphthoselenazole nucleus, a pyridine nucleus or a quinoline nucleus. $Y_{31}$ represents an oxygen atom, a sulfur atom or a selenium atom.

The two cyanine heterocyclic nuclei may be substituted with the substituents as shown for the formula [V-a].

Also, $R_{31}$, $R_{32}$, $R_{33}$, $X_3\ominus$ and n are the same as shown for the formula [V-a].

Among the sensitizing dyes represented by the formula [V-b], particularly useful are those represented by the formula [V-c]:

Formula [V-c]

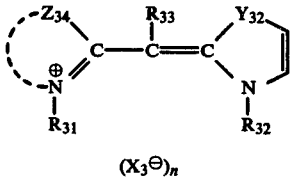

In the above formula, $Z_{34}$ represents atoms necessary for formation of a benzothiazole nucleus, a naphthothiazole nucleus, a benzoselenazole nucleus, or a naphthoselenazole nucleus. $Y_{32}$ represents a sulfur atom or a selenium atom.

The two cyanine heterocyclic nuclei may be substituted with the substituents as shown for the formula [V-a].

Also, $R_{31}$, $R_{32}$, $R_{33}$, $X_3\ominus$ and n are the same as shown

Dyes represented by the formula [III]

(III-1)

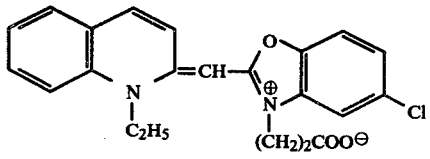

(III-2)

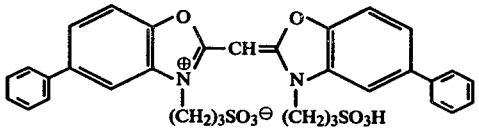

(III-3)

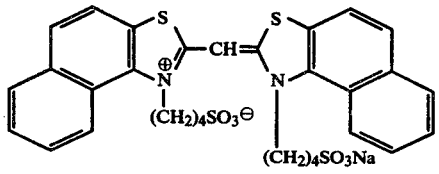

(III-4)

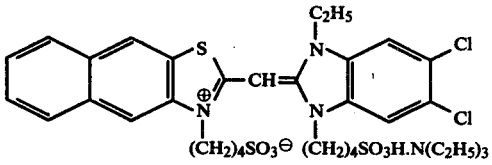

(III-5)

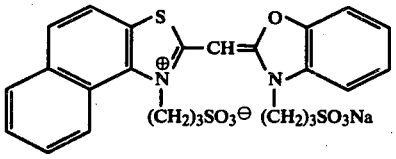

(III-6)

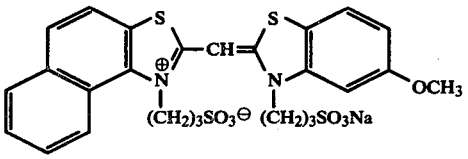

(III-7)

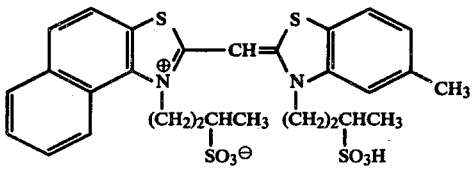

(III-8)

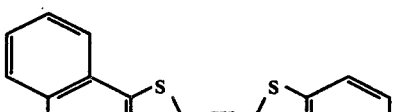

-continued
Dyes represented by the formula [III]
(III-9)
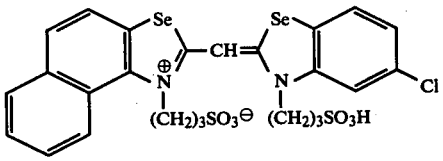
(III-10)
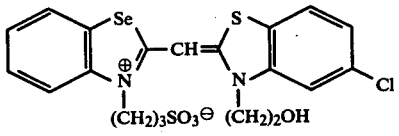
(III-11)
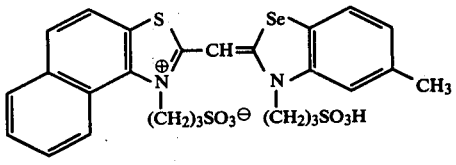
(III-12)
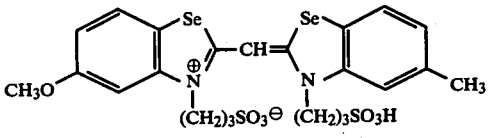
(III-13)
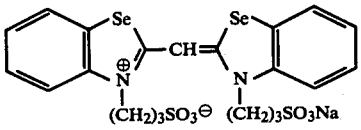
(III-14)
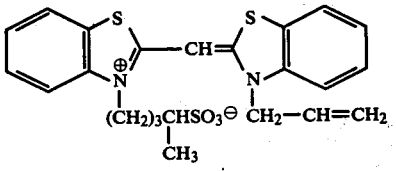
(III-15)
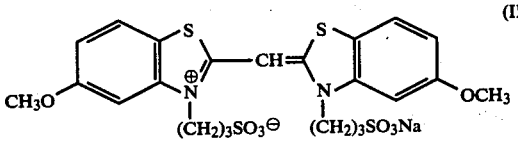
(III-16)
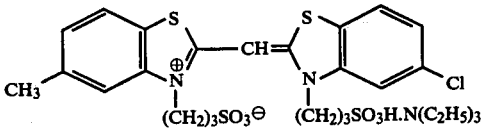
(III-17)
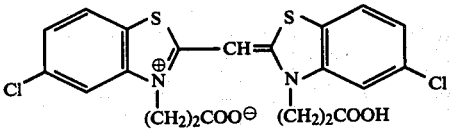
-continued
Dyes represented by the formula [III]
(III-18)
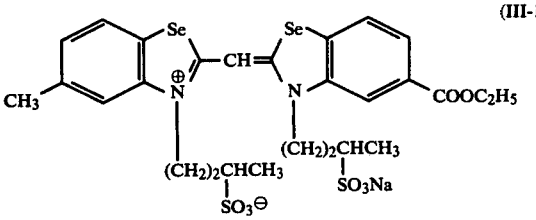
(III-19)
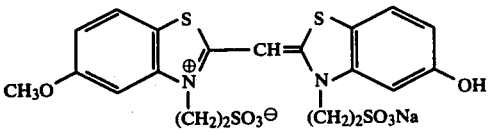
(III-20)
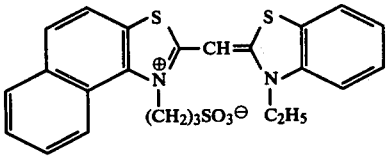
(III-21)
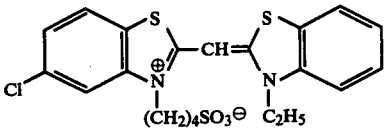
(III-22)
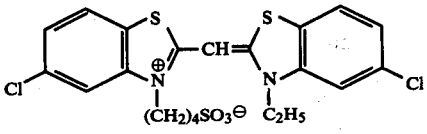
Dyes represented by the formula [IV]
(IV-1)
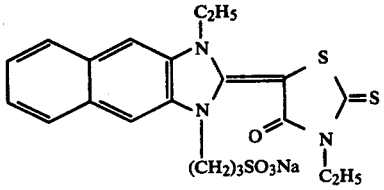
(IV-2)
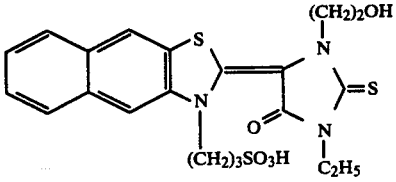
(IV-3)
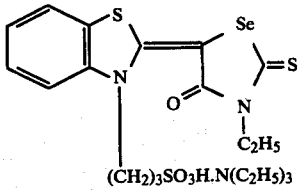

-continued
Dyes represented by the formula [IV]
(IV-4)
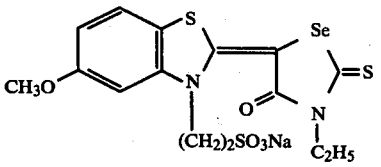
(IV-5)
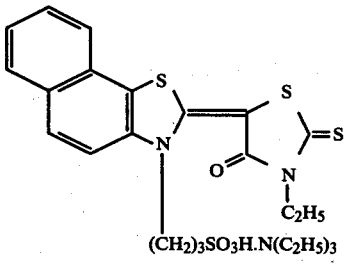
(IV-6)
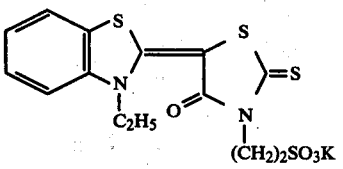
(IV-7)
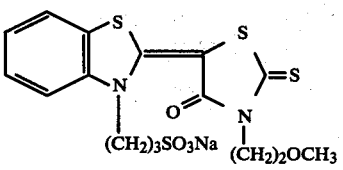
(IV-8)
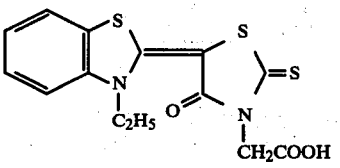
(IV-9)
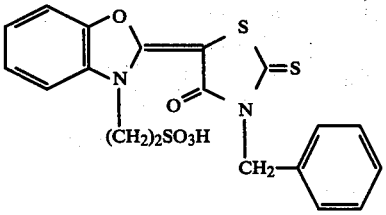
(IV-10)
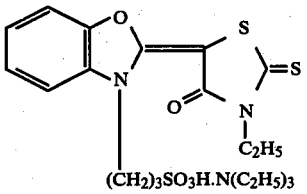
(IV-11)
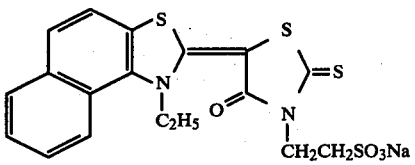
-continued
Dyes represented by the formula [IV]
(IV-12)
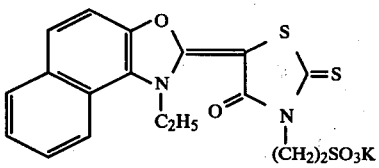
Dyes represented by the formula [V]:
(V-1)
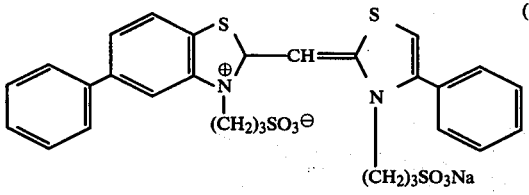
(V-2)
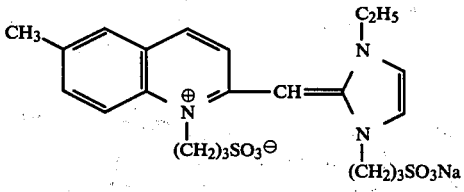
(V-3)
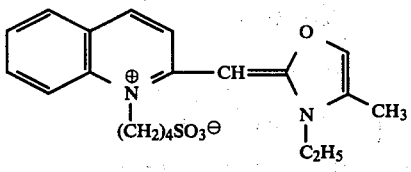
(V-4)
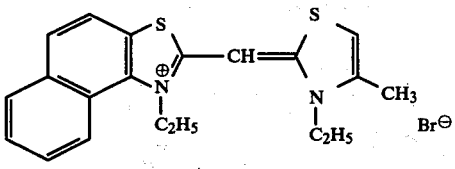
(V-5)
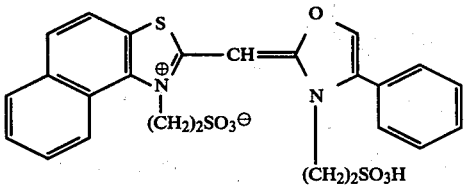
(V-6)
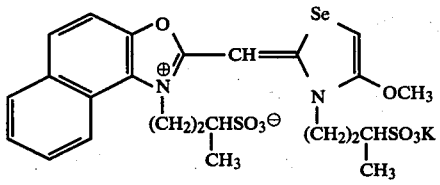
(V-7)
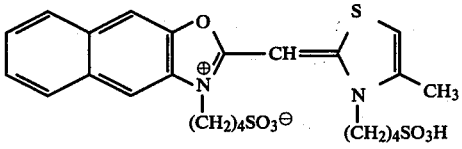

-continued

Dyes represented by the formula [V]:

(V-8)

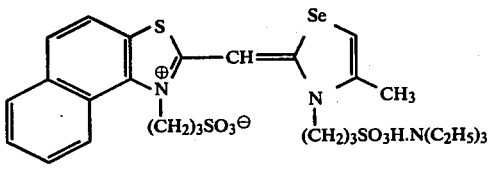

(V-9)

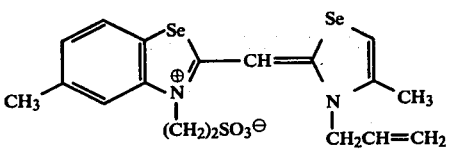

(V-10)

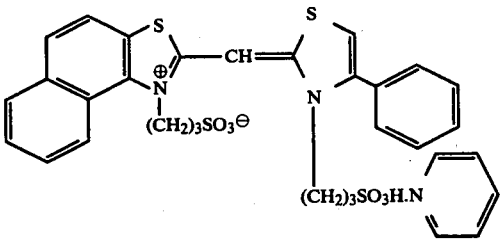

(V-11)

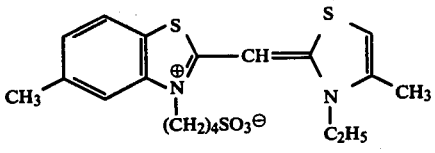

Dyes represented by the formula [VI]:

(VI-1)

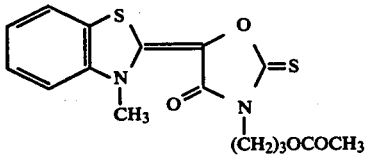

(VI-2)

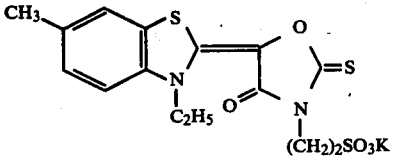

(VI-3)

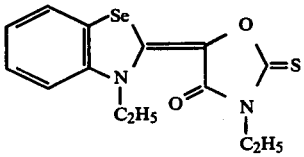

(VI-4)

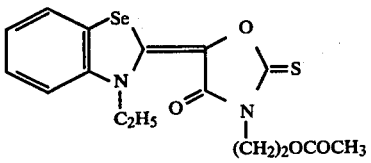

-continued

Dyes represented by the formula [VI]:

(VI-5)

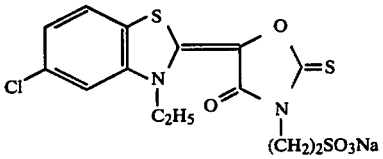

(VI-6)

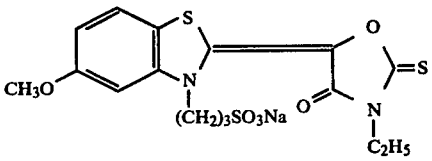

(VI-7)

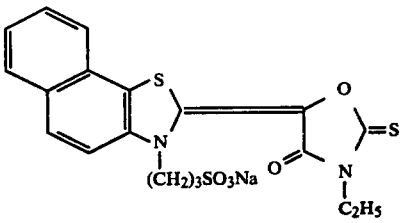

(VI-8)

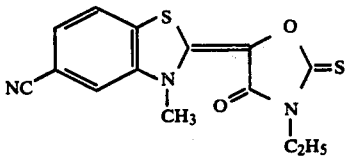

(VI-9)

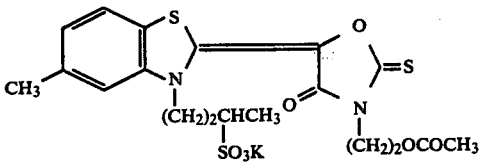

(VI-10)

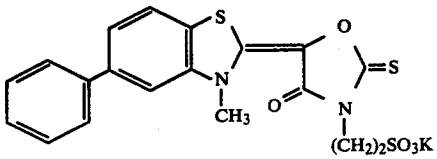

(VI-11)

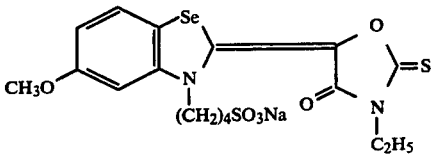

The longer wavelength dye and the shorter wavelength dye described above are all well known in the art and can be synthesized easily according to the methods as described in, for example, F. M. Harmer "The Chemistry of Heterocyclic Compounds", Vol. 18, "The Cyanine Dyes and Related Compounds", (A. Weissberger ed., Interscience Co., New York, 1964).

The optimum concentration of the sensitizing dye to be used in this invention can be determined in a conventional manner well known to those skilled in the art. For example, there may be preferably used the method in which the same emulsion is divided into several aliquots, and to the respective aliquots are added sensitizing dyes with different concentrations, followed by measurements of sensitivities of respective samples to determine the optimum concentration.

The amount of the sensitizing dye to be used in the silver halide emulsion according to this invention is not particularly limited, but it is advantageous to employ a sensitizing dye in an amount of $2\times10^{-6}$ mole to $1\times10^{-3}$ mole per mole of silver halide. Particularly advantageous is a range from $1\times10^{-4}$ mole to $5\times10^{-4}$ mole per mole of silver halide for the longer wavelength dye and the shorter wavelength dye, and a range from $5\times10^{-6}$ mole to $5\times10^{-4}$ mole per mole of silver halide for the sensitizing dyes represented by the formulae [III] through [VI].

The advantageous ratio of (longer wavelength dye)/(shorter wavelength dye) when combining the longer wavelength dye and the shorter wavelength dye may be 20/1 to 1/20, particularly 10/1 to 1/10, in terms of molar ratio.

The sensitizing dyes according to this invention may be added to an emulsion by the methods well known in this kind of field.

For example, these sensitizing dyes may be dispersed directly into an emulsion or dissolved in a water miscible solvent such as pyridine, methyl alcohol, ethyl alcohol, methyl cellosolve, acetone, etc. (or a mixture of these solvents) or sometimes diluted with water or sometimes dissolved in water and added in the form of these solutions into an emulsion. During such dissolution operations, ultra-sonic vibration may also be employed. It is also possible to employ the method to dissolve a dye in a volatile organic solvent, dispersing said solution into a hydrophilic colloid and adding the dispersion into an emulsion, as disclosed in U.S. Pat. No. 3,469,987 or the method in which a water insoluble dye is dispersed without dissolution into a water miscible solvent and adding the dispersion into an emulsion, as disclosed in Japanese Patent Publication No. 24185/1971. Dye may also be added in the form of the dispersion according to the acid dissolving dispersing method into an emulsion. Otherwise, there may also be employed the methods for addition of the dyes into emulsions as disclosed in U.S. Pat. Nos. 2,912,345, 3,342,605, 2,996,287, 3,425,835 and others.

The sensitizing dyes to be incorporated in combination in this invention may be dissolved in the same or different solvents, and these solutions mixed prior to addition into a silver halide emulsion or added separately thereinto. When they are added separately, the order of addition and the time interval may optionally be determined as desired depending on the purpose. Addition of the sensitizing dyes according to this invention may be conducted at any time during the steps for preparation of the emulsion, but preferably during chemical ripening or after chemical ripening.

The emulsion according to this invention is a negative working emulsion, namely an emulsion of the so-called surface latent image type, in which a latent image is formed primarily on the grain surfaces thereof. The term of surface latent image type emulsion is the terminology representing the concept opposed to the term of internal latent image type emulsion as defined in, for example, Japanese Provisional Patent Publication No. 32814/1972. In a negative working emulsion, the image to be provided for practical use is formed by elevation of the image density as the increase of exposure. Of course, in such an emulsion, a phenomenon of so-called solarization may occur in which inversion is caused by excessive dosage of exposure, but this is no problem because it is a phenomenon caused by (a dosage of) exposure exceeding the normal exposure for practical use.

The silver halide to be used in this invention is a silver halide comprising 80 mole % or more, preferably 90 mole % or more, of silver chloride. Most preferably, pure silver chloride is used. In this case, the remainder of the silver halide other than silver chloride is constituted for a great part of silver bromide, which may be of course wholly silver bromide or contain several % of silver iodide depending on the use.

The silver halide to be used in this invention may be used preferably, whether it may have a plane (100) or a plane (111) or both thereof on its outer surface. A silver halide having a (110) plane on its outer surface may also preferably be used.

The grain sizes of the silver halide to be used in this invention may be within the range useable as ordinary light-sensitive photographic material, but preferably within the range of average grain size from 0.05 μm to 1.0 μm. The grain size distribution may be either polydispersed or mono-dispersed, the latter being preferred.

The silver halide grains to be used in this invention may be prepared according to the methods conventionally practiced by those skilled in the art. These methods are described in textbooks such as, for example, "The Theory of Photographic Process" by Mess (published by Macmillan Publishing Co.), and preparation may be possible according to various generally known methods such as the ammoniacal emulsion making method, neutral or acid emulsion making method, etc. As a preferable method, preparation may be conducted by mixing a water soluble silver salt with a water soluble halide salt in the presence of an appropriate protective colloid, and controlling the temperature, pAg, pH values, etc. at suitable values during formation of silver halide by precipitation.

The silver halide emulsion may be either subjected to physical aging or not. The emulsion is usually freed of the water soluble salts after formation of precipitation or after physical aging. As the method for this purpose, there may be employed either the noodle washing method which has been known for a long time or the flocculation method utilizing inorganic salts having polyvalent anions (e.g., ammonium sulfate, magnesium sulfate), anionic surfactants, polystyrene sulfonic acid or other anionic polymers, or gelatin derivatives such as aliphatic or aromatic-acylated gelatin.

The silver halide emulsion to be used in this invention can be subjected to chemical ripening according to the methods conventionally practiced by those skilled in the art. For example, there may be employed the methods as described in textbooks such as the aforesaid "The Theory of Photographic Process" by Mess, or other various known methods. That is, it is possible to use individually or in combination the sulfur sensitizing method employing a compound containing sulfur reactive with silver ions, as exemplified by thiosulfates or compounds as disclosed in U.S. Pat. Nos. 1,574,944, 2,278,947, 2,410,689, 3,189,458, 3,501,313, French Pat. No. 20 59245, or an active gelatin; the reduction sensitization method employing a reducing material, as exemplified by the stannous salts disclosed in U.S. Pat. No. 2,487,850, amines disclosed in U.S. Pat. Nos. 2,518,698, 2,521,925, 2,521,926, 2,419,973, 2,419,975, etc., iminoaminomethane sulfinic acid disclosed in U.S. Pat. No. 2,983,610, silane compounds disclosed in U.S. Pat. No. 2,694,637, or according to the method of H. W. Wood disclosed in Journal of Photographic Science, Vol. 1 (1953), page 163 et seq.; the gold sensitizing method employing gold complex salts or gold thiosulfate complex salts disclosed in U.S. Pat. No. 2,399,083; or the sensitization method employing salts of noble metals such as platinum, palladium, iridium, rhodium, ruthenium disclosed in U.S. Pat. Nos. 2,448,060, 2,540,086, 2,566,245, 2,566,263. In place of or together with the sulfur sensitizing method, there may be used the selenium sensitizing method disclosed in U.S. Pat. No. 3,297,446.

In the emulsion to be used in this invention, geltain is primarily used as protective colloid. Particularly, an inert gelatin is useful. In place of gelatin, there may also be employed photographically inert gelatin derivatives (e.g., phthalated gelatin, etc.), water soluble synthetic polymers (e.g., polyvinyl alcohol, polyvinyl pyrrolidone, carboxymethyl cellulose, hydroxymethyl cellulose, etc.) and the like.

It is also possible to incorporate tetrazaindenes, mercaptotetrazoles or other compounds in the photographic emulsion according to this invention, for the purpose of stabilizing the photographic performance in the preparation steps and during storage, and preventing fog at the time of developing process.

The light-sensitive photographic material of this invention may be either coupler in emulsion type light-sensitive photographic material or coupler in developer type light-sensitive photographic material.

As the coupler to be incorporated in the light-sensitive photographic material according to this invention, there may be employed any compound which can undergo coupling reaction with an oxidized color developing agent to form a coupled product having the maximum spectral absorption wavelength at a longer wavelength region than 340 nm, of which typical examples are set forth below.

As the coupler forming a coupling product having the maximum spectral absorption wavelength in the wavelength region from 350 nm to 500 nm, typical examples are those known to those skilled in the art as so-called yellow coupler, as disclosed in U.S. Pat. Nos. 2,186,849, 2,322,027, 2,728,658, 2,875,057, 3,265,506, 3,277,155, 3,408,194, 3,415,652, 3,447,928, 3,664,841, 3,770,446, 3,778,277, 3,849,140, 3,894,875, U.K. Pat. Nos. 778,089, 808,276, 875,476, 1,402,511, 1,421,126 and 1,513,832 and Japanese Patent Publication No. 13576/1974, Japanese Provisonal Patent Publications Nos. 29432/1973, 66834/1973, 10736/1974, 122335/1974, 28834/1975, 132926/1975, 138832/1975, 3631/1976, 17438/1976, 26038/1976, 26039/1976, 50734/1976, 53825/1976, 75521/1976, 89728/1976, 102636/1976, 107137/1976, 117031/1976, 122439/1976, 143319/1976, 9529/1978, 82332/1978, 135625/1978, 145619/1978, 23528/1979, 48541/1979, 65035/1979, 133329/1979 and 598/1980.

As the coupler forming a coupling product having the maximum spectral absorption wavelength in the wavelength region from 500 nm to 600 nm, typical examples are those known to those skilled in the art as so-called magenta coupler, as disclosed in U.S. Pat. Nos. 1,969,479, 2,213,986, 2,294,909, 2,338,677, 2,340,763, 2,343,703, 2,359,332, 2,411,951, 2,435,550, 2,592,303, 2,600,788, 2,618,641, 2,619,419, 2,673,801, 2,691,659, 2,803,554, 2,829,975, 2,866,706, 2,881,167, 2,895,826, 3,062,653, 3,127,269, 3,214,437, 3,253,924, 3,311,476, 3,419,391, 3,486,894, 3,519,429, 3,558,318, 3,617,291, 3,684,514, 3,705,896, 3,725,067, 3,888,680, U.K. Pat. Nos. 720284, 737700, 813866, 892886, 918128, 1019117, 1042832, 1047612, 1398828, 1398979, German Pat. Nos. 814,996, 1,070,030, Belgian Pat. No. 724,427, Japanese Provisional Patent Publications Nos. 60479/1971, 29639/1974, 111631/1974, 129538/1974, 13041/1975, 116471/1975, 159336/1975, 3232/1976, 3233/1976, 10935/1976, 16924/1976, 20826/1976, 26541/1976, 30228/1976, 36938/1976, 37230/1976, 37646/1976, 39039/1976, 44927/1976, 104344/1976, 105820/1976, 108842/1976, 112341/1976, 112342/1976, 112343/1976, 112344/1976, 117032/1976, 126831/1976, 31738/1977, 9122/1978, 55122/1978, 75930/1978, 86214/1978, 125835/1978, 123129/1978 and 56429/1979.

As the coupler forming a coupling product having the maximum spectral absorption wavelength in the wavelength region from 600 nm to 750 nm, typical examples are those known to those skilled in the art as so-called cyan coupler, as disclosed in U.S. Pat. Nos. 2,306,410, 2,356,475, 2,362,598, 2,367,531, 2,369,929, 2,423,730, 2,474,293, 2,476,008, 2,498,466, 2,545,687, 2,728,660, 2,772,162, 2,895,826, 2,976,146, 3,002,836, 3,419,390, 3,446,622, 3,476,563, 3,737,316, 3,758,308, 3,839,044, U.K. Pat. Nos. 478991, 945542, 1084480, 1377233, 1388024, and 1543040, Japanese Provisional Patent Publications Nos. 37425/1972, 10135/1975, 25228/1975, 112038/1975, 117422/1975, 130441/1975, 6551/1976, 37647/1976, 52828/1976, 108841/1976, 109630/1978, 48237/1979, 66129/1979, 131931/1979, 32071/1980.

As the coupler forming a coupling product having the maximum spectral absorption wavelength in the wavelength region from 700 nm to 850 nm, typical examples are disclosed in Japanese Patent Publication No. 24849/1977, Japanese Provisional Patent Publications Nos. 125836/1978, 129036/1978, 21094/1980, 21095/1980, 21096/1980, etc.

The negative working silver halide photographic emulsion according to this invention may preferably be used together with yellow couplers. An especially preferable yellow coupler is an $\alpha$-pivalylacetanilide type yellow coupler. The silver halide emulsion of this invention may also be employed in combination with magenta couplers. Among them, a preferable magenta coupler is a 5-pyrazolone type magenta coupler. When these couplers are included within the light-sensitive photographic material, they are included according to a technically effective method so as to be dispersed into the hydrophilic colloid. As the method for dispersing these couplers, there may be employed various well known methods, especially preferably the method in which these couplers are dissolved in substantially water insoluble high boiling point solvents and dispersed into hydrophilic colloids.

As particularly useful high boiling point solvents, there may be mentioned, for example, N-n-butylacetanilide, diethyllauramide, dibutyllauramide, dibutylphthalate, dioctylphthalate, tricresyl phosphate, N-dodecylpyrrolidone, etc. For aiding in the above dissolution, there may be employed low boiling point solvents or organic solvents readily soluble in water. As low boiling point solvents and organic solvents readily soluble in water, there may be employed, for example, ethyl acetate, methyl acetate, cyclohexanone, acetone, methanol, ethanol, tetrahydrofuran, 2-methoxyethanol, diethylformamide, etc. These low boiling point solvents and organic solvents readily soluble in water can be removed by washing with water or drying after coated.

Further, the silver halide emulsion according to this invention may also contain various other additives for photography, including for example well known hardeners, surfactant, UV absorbers, fluorescent whiteners, physical property modifiers (humectants, water dispersants of polymer), condensates of phenols and formalin, etc.

And, the silver halide photographic emulsion according to this invention is generally coated on a suitable support and dried to prepare a light-sensitive silver halide photographic material. As the support to be employed, there are supports such as of paper, glass, cellulose acetate, cellulose nitrate, polyester, polyamide, polystyrene and the like, or laminated products of two or more substrates such as laminated products of paper and polyolefin (e.g., polyethylene, polypropylene, etc.). And, the support may be subjected generally to various surface modification treatments for improvement of adhesion to the silver halide emulsion, such as the surface treatment of, for example, electron impart treatment, etc. or subbing treatment to provide a subbing layer.

Coating and drying of the silver halide photographic emulsion on the support may be conducted according to conventional procedures by carrying out coating by, for example, dip coating, roller coating, multi-slide hopper coating, curtain flow coating, etc., followed by drying.

The light-sensitive silver halide photographic material is basically constituted as described above. Further, by combining suitably various photographic constituent layers selected, if desired, from layers sensitized to other wavelength regions, namely green sensitive and red sensitive silver halide photographic emulsion layers, intermediate layers, protective layers, filter layers, antihalation layers, backing layers and others, a light-sensitive color photographic material can be formed. In this case, each light-sensitive emulsion layer may be constituted of two emulsion layers with different sensitivites.

After the light-sensitive photographic material of this invention is exposed to light, various photographic process may be applied thereon. The processing temperature and time may be suitably be set, and the temperature may be at room temperature, lower than room temperature, for example, 18° C. or lower, or higher than room temperature, for example, over 30° C., for example, at around 40° C., further a temperature over 50° C.

For color development, as the color developing agent, there may be employed, for example, N,N-dimethyl-p-phenylenediamine, N,N-diethyl-p-phenylenediamine, N-carbamidomethyl-N-methyl-p-phenylenediamine, N-carbamidomethyl-N-tetrahydrofurfuryl-2-methyl-p-phenylenediamine, N-ethyl-N-carboxymethyl-2-methyl-p-phenylenediamine, N-carbamidomethyl-N-ethyl-2-methyl-p-phenylenediamine, N-ethyl-N-tetrahydrofurfuryl-2-methyl-p-aminophenol, 3-acetylamino-4-aminodimethylaniline, N-ethyl-N-$\beta$-methanesulfonamidoethyl-4-aminoaniline, N-ethyl-N-$\beta$-methanesulfonamidoethyl-3-methyl-4-aminoaniline, sodium salt of N-methyl-N-$\beta$-sulfoethyl-p-phenylenediamine, etc.

The light-sensitive photographic material of this invention contains these color developing agents as such, or alternatively as precursors thereof which may be processed with an alkaline activating bath. The color developing agent precursors are compounds capable of forming color developing agents under alkaline conditions, including Schiff base type precursors with aromatic aldehyde derivatives, polyvalent metal ion complex precursors, phthalimide derivative precursors, phosphoramid derivative precursors, sugar-amine reaction product precursors, urethane type precursors, and the like. These precursors of aromatic primary amine color developing agents are disclosed in, for example, U.S. Pat. Nos. 3,342,599, 2,507,114, 2,695,234, 3,719,492, U.K. Pat. No. 803783, Japanese Provisional Patent Publications Nos. 135628/1978, 79035/1979, Research Disclosures No. 15159, No. 12146, No. 13924.

These aromatic primary amine color developing agents or precursors thereof should be added in amounts so as to obtain sufficient color formation with said amounts alone, when processed with activating bath. Such amounts, which may differ considerably depending the kind of the light-sensitive photographic material, may be approximately within the range from 0.1 mole to 5 moles preferably 0.5 mole to 3 moles, per mole of the light-sensitive silver halide, to obtain advantageous results. These color developing agents or precursors thereof may be used either individualy or in combination. For inclusion in the light-sensitive photographic material, they may be added as solutions in an appropriate solvent such as water, methanol, ethanol, acetone, etc. or as emulsions with the use of a high boiling point solvent such as dibutylphthalate, dioctylphthalate, tricresyl phosphate, etc. Alternatively, it is also possible to incorporate them by impregnation in a latex polymer, as disclosed in Research Disclosure No. 14850.

Usually, after color development, bleaching process and fixing process are carried out. Bleaching process may be performed simultaneously with fixing process. As the bleaching agent, there may be employed a large number of compounds, preferably polyvalent metal compounds such as iron(III), cobalt (III), copper(II), particularly complex salts of these polyvalent metal cations with organic acids, including metal complexes of aminopolycarboxylic acids such as ethylenediaminetetraacetic acid, nitrilotriacetic acid, N-hydroxyethylethylenediaminediacetic acid; metal complex salts of malonic acid, tartaric acid, malic acid, diglycolic acid, dithioglycolic acid and the like; or ferricyanate, dichromates, either individually or in a suitable combination.

The light-sensitive color photographic material according to this invention can be applied effectively for various uses such as color negative film, color reversal film or color photographic paper, and it is particularly useful for use in color photographic papers.

The preferred embodiments of this invention are as follows:

1. A light-sensitive silver halide color photographic material according to claims, containing a yellow coupler.

2. A light-sensitive silver halide color photographic material according to claims, wherein at least one layer of the negative working silver halide emulsions is a blue-sensitive silver halide emulsion layer, and a yellow coupler is contained in said blue-sensitive silver halide emulsion.

3. A light-sensitive silver halide color photographic material according to claims, having a blue-sensitive emulsion layer containing a yellow coupler, a green-sensitive emulsion layer containing a magenta coupler and a red-sensitive emulsion layer containing a cyan coupler in the order nearer to the support.

4. A light-sensitive silver halide color photographic material according to claims, characterized by spectral sensitized with at least one of sensitizing dye represented by the formula [IV] and at least one of sensitizing dye represented by the formula [V].

5. A light-sensitive silver halide color photographic material according to claims, characterized by being spectral sensitized with at least one sensitizing dye represented by the following formula [V-b] and at least one sensitizing dye represented by the following formula [III-c]:

Formula [V-b]

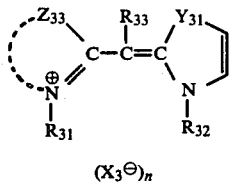

$(X_3^{\ominus})_n$ wherein $Z_{33}$ represents an atomic group necessary for formation of a benzoxazole nucleus, a naphthoxazole nucleus, a benzothiazole nucleus, a naphthothiazole nucleus, a benzoselenazole nucleus, a naphthoselenazole nucleus, a pyridine nucleus or a quinoline nucleus; $Y_{31}$ represents an oxygen atom, a sulfur atom or a selenium atom; $R_{31}$ and $R_{32}$ represent each independently an alkyl group, an alkenyl group or an aryl group; $R_{33}$ represents a hydrogen atom, a methyl group or an ethyl group; $X_3^{\ominus}$ represents an anion; and n represents 0 or 1.

Formula [III-c]

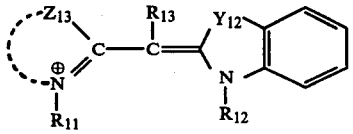

$(X_1^{\ominus})_l$ wherein $Z_{13}$ is an atomic group necessary for formation of a benzothiazole nucleus, a benzoselenazole nucleus, a naphthothiazole nucleus or a naphthoselenazole nucleus; $Y_{12}$ represents a sulfur atom or a selenium atom; $R_{11}$ and $R_{12}$ represent each independently an alkyl group, an aryl group or an alkenyl group; $R_{13}$ represents a hydrogen atom, a methyl group or an ethyl group; $X_1^{\ominus}$ represents an anion; and l represents 0 or 1.

6. A light-sensitive silver halide color photographic material according to claims, characterized by being spectral sensitized with at least one sensitizing dye represented by the following formula [V-c] and at least one sensitizing dye represented by the formula [III-d]:

Formula [V-c]

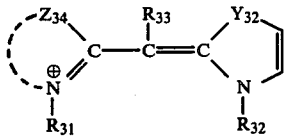

$(X_3^{\ominus})_n$ wherein $Z_{34}$ represents an atomic group necessary for formation of a benzothiazole nucleus, a naphthothiazole nucleus, a benzoselenazole nucleus or a naphthoselenazole nucleus; $Y_{32}$ represents a sulfur atom or a selenium atom; $R_{31}$ and $R_{32}$ represent each independently an alkyl group, an aryl group or an alkenyl group; $R_{33}$ represents a hydrogen atom, a methyl group or an ethyl group; $X_3^{\ominus}$ represents an anion; and n represents 0 or 1.

Formula [III-d]

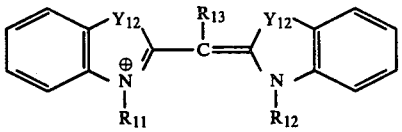

$(X_1^{\ominus})_l$ wherein $Y_{12}$ represents a sulfur atom or a selenium atom; $R_{11}$ and $R_{12}$ represent each independently an alkyl group, an alkenyl group or an aryl group; $R_{13}$ represents a hydrogen atom, a methyl group or an ethyl group; $X_1^{\ominus}$ represents an anion; and l represents 0 or 1.

7. A light-sensitive silver halide color photographic material according to claims, characterized by being spectral sensitized with at least one sensitizing dye represented by the aforesaid formula [V-c] and at least one sensitizing dye represented by the following formula [III-b']:

Formula [III-b']

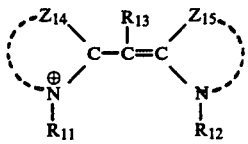

$(X_1^{\ominus})_l$ wherein $Z_{14}$ and $Z_{15}$ each represents atoms necessary for formation of a naphthothiazole nucleus or a naphthoselenazole nucleus; $R_{11}$ and $R_{12}$ each represents an alkyl group, an alkenyl group or an aryl group; $R_{13}$ represents a hydrogen atom, a methyl group or an ethyl group; $X_1^{\ominus}$ represents an anion; and l represents 0 or 1.

8. A light-sensitive silver halide color photographic material according to claims, characterized by being spectral sensitized with at least one sensitizing dye represented by the following formula [V-b] and at least one sensitizing dye represented by the formula [IV-c]:

Formula [V-b]

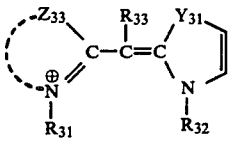

$(X_3^{\ominus})_n$ wherein $Z_{33}$ represents an atomic group necessary for formation of a benzoxazole nucleus, a naphthoxazole nucleus, a benzothiazole nucleus, a naphthothiazole nucleus, a benzoselenazole nucleus, a naphthoselenazole nucleus, a pyridine nucleus or a quinoline nucleus; $Y_{31}$ represents an oxygen atom, a sulfur atom or a selenium atom; $R_{31}$ and $R_{32}$ represent each independently an alkyl group, an alkenyl group or an aryl group; $R_{33}$ represents a hydrogen atom, a methyl group or an ethyl group; $X_3^{\ominus}$ represents an anion; and n represents 0 or 1.

Formula [IV-c]

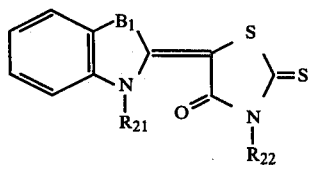

wherein $B_1$ represents an oxygen atom, a sulfur atom or a selenium atom; and $R_{21}$ and $R_{22}$ each represent an alkyl group, an alkenyl group or an aryl group.

9. A light-sensitive silver halide color photographic material according to the embodiment 8, wherein in the formula [V-b], $Z_{33}$ represents atoms necessary for formation of a benzothiazole nucleus, a naphthothiazole nucleus, a benzoselenazole nucleus or a naphthoselenazole nucleus and $Y_{31}$ represents a sulfur atom or a selenium atom.

10. A light-sensitive silver halide color photographic material according to claims, characterized by being spectral sensitized with at least one kind of sensitizing dyes represented by the formula [VI] and at least one kind of sensitizing dyes represented by the formula [III-c].

11. A light-sensitive silver halide color photographic material according to the embodiment 10, wherein in the formula [III-c], $Z_{13}$ represents atoms necessary for formation of a benzothiazole nucleus or a benzoselenazole nucleus.

12. A light-sensitive silver halide color photographic material according to claims, characterized by being spectral sensitized with at least one kind of sensitizing dyes represented by the formula [III-b'] and at least one kind of sensitizing dyes represented by the formula [VI].

13. A light-sensitive silver halide color photographic material according to claims, characterized by being spectral sensitized with at least one kind of sensitizing dyes represented by the formula [VI] and at least one kind of sensitizing dyes represented by the formula [IV-c].

14. A light-sensitive silver halide color photographic material according to claims, characterized by being spectral sensitized with at least one kind of sensitizing dyes represented by the formula [III] or [IV] and at least one kind of sensitizing dyes represented by the formula [V] or [VI] at a molar ratio of 1:10 to 10:1.

EXAMPLE 1

A silver chloride emulsion with an average grain size of 0.70 μm was prepared and chemical ripening was conducted in a conventional manner with the use of $8.2\times10^{-6}$ mole of sodium thiosulfate per mole of silver halide. The conditions for chemical ripening were set so that the time and the temperature may be optimized for the best photographic performance. Five minutes before termination of chemical ripening sensitizing dyes (I-7) and (I-7) together with (II-1) were added, respectively, to the emulsions as shown in Table 1. Further, into the emulsions having incorporated respective sensitizing dyes, stabilizer (ST-1) was added in an amount of 1 g per mole of silver halide. Also, 0.3 mole of a yellow coupler (YC-1) per mole of silver halide and 0.15 mole of a color stain preventing agent (AS-1) per mole of said coupler, which are dispersed in dibutyl phthalate (hereinafter abbreviated as DBP), were added at the same time to the emulsions. On a paper support for photography coated with polyethylene containing anatase type titanium oxide, the above emulsions were coated in amounts of coated silver of 0.35 g/m² as metallic silver to the gelatin content of 3.0 g/m², followed further by application of a protective layer to the gelatin content of 2.0 g/m².

In the protective layer, there were incorporated bis(vinylsulfonylmethyl)ether as hardener and saponin as surfactant. Thus, Samples 1~6 were prepared, and by means of a photosensitometer KS-7 Model (produced by Konishiroku Photo Industry Ltd.), respective samples were subjected to (a) wedgewise exposure by use of a tungsten lamp (color temperature 2854 K.) as such as light source, (b) wedgewise exposure by the light transmitted through an interference filter having the transmittance maximum at 430 nm and (c) wedgewise exposure by the light transmitted through an interference filter having the transmittance maximum at 470 nm.

On the respective samples subjected to the three kinds of exposures (a)~(c) as described above, there were subsequently applied the color development as shown below. The reflective densities of the dye images formed in respective samples were measured by means of Sakura Color Densitometer PDA-60 Model (produced by Konishiroku Photo Industry Ltd.) with the use of an auxiliary blue filter to obtain relative sensitivities and fog. Relative sensitivity is represented with the Sample 1 being 100 in case of using no interference filter, and in case of exposure using interference filters in terms of sensitivity by exposure at 470 nm with the sensitivity for each sample by exposure at 430 nm being 100.

| | |
|---|---|
| (ST - 1) | 4-Hydroxy-6-methyl-1,3,3a,7-tetrazaindene |
| (YC - 1) | α-(1-Benzyl-2,4-dioxo-3-imidazolydinyl)-α-pivalyl-2-chloro-5-[γ-(2,4-di-t-amylphenoxy)butaneamido]acetanilide |
| (AS - 1) | 2,5-Di-t-octylhydroquinone |

| Processing steps | |
|---|---|
| Color development (CD - 1): | 33° C. 1 minute |
| Bleach-fix: | 33° C. 1.5 minutes |
| Washing: | 30 ~34° C. 3 minutes |
| Drying: | |

| Composition of color developer (CD - 1) | |
|---|---|
| Pure water | 800 ml |
| Ethylene glycol | 12 ml |
| Benzyl alcohol | 12 ml |
| Anhydrous potassium carbonate | 30 g |
| Anyhdrous potassium sulfite | 2.0 g |
| N—ethyl-N—(β-methanesulfonamido)-ethyl-3-methyl-4-aminoaniline sulfate | 4.5 g |
| Adenine | 0.03 g |
| Sodium chloride | 1.0 g |

(adjust with potassium hydroxide or sulfuric acid to pH=10.2 and then make up to 1 liter.)

| Composition of bleach-fix solution | |
|---|---|
| Pure water | 750 ml |
| Sodium ethylenediaminetetraacetato ferrate (III) | 50 g |
| Ammonium thiosulfate | 85 g |
| Potassium bisulfite | 10 g |
| Sodium metabisulfite | 2 g |

-continued

| Composition of bleach-fix solution | |
|---|---|
| Disodium ethylenediaminetetraacetate | 20 g |
| Sodium bromide | 3.0 g |
| (make up to one liter with pure water, followed by adjustment to pH = 7.0 with ammonia water or sulfuric acid.) | |

The results are shown in Table 1.

TABLE 1

| Sample No. | Amount of sensitizing dye added ($\times 10^{-4}$ mole/mole AgX) | | Sensitivity without filter | Relative sensitivity*1 at 470 nm | Fog |
|---|---|---|---|---|---|
| 1 | (I - 7) | 3.0 | 100 | 158 | 0.05 |
| 2 | (I - 7) | 2.8 | 95 | 102 | 0.05 |
| | (II - 1) | 0.2 | | | |
| 3 | (I - 7) | 2.5 | 88 | 75 | 0.04 |
| | (II - 1) | 0.5 | | | |
| 4 | (I - 7) | 1.5 | 65 | 65 | 0.05 |
| | (II - 1) | 1.5 | | | |
| 5 | (I - 7) | 0.5 | 58 | 50 | 0.05 |
| | (II - 1) | 2.5 | | | |
| 6 | (II - 1) | 3.0 | 52 | 1 | 0.05 |

*1 Sensitivity to the light at 470 nm, with the sensitivity to the light at 430 nm as being 100.

As apparently seen from Table 1, the sensitivity in case of employing the sensitizing dye (I-7) alone (Sample 1) is higher than other cases. However, while setting side the sensitivity in case of using no filter, there is the problem of the imbalance between the sensitivity at the shorter wavelength side (~430 nm) and that at the longer wavelength side (~470 nm) in the blue light region. In the combinations of the sensitizing dyes according to this invention (Samples 2~5), good balances can be seen as contrasted to the cases in which respective sensitizing dyes were employed individually (Samples 1, 6), which are markedly deficient in balance.

EXAMPLE 2

On a paper support for photography laminated with a polyethylene film containing an anatase type titanium oxide, corona discharging treatment was applied, and the following six layers were coated successively thereon to prepare a light-sensitive photographic material for print. The amounts of respective materials are represented in terms of weight per 1 $m^2$ of the light-sensitive photographic material, and silver halide is calculated as metallic silver.

Layer 1

A blue-sensitive emulsion layer comprising a dispersion of 0.4 g of DBP having dissolved 0.8 g of a yellow coupler (YC-1) and 0.015 g of a color stain preventing agent (AS-1), a blue-sensitive silver chloride emulsion (6 kinds were prepared under the same conditions as in Example 1) and 1.47 g of gelatin.

Layer 2

A first intermediate layer comprising a dispersion of 0.03 g of DBP having dissolved 0.015 g of color stain preventing agent (AS-1), and 1.03 g of gelatin.

Layer 3

A green-sensitive emulsion layer comprising a dispersion of 0.34 g of tricresyl phosphate (hereinafter written as TCP) having dissolved 0.63 g of a magenta coupler (MC-1) and 0.015 g of a color stain preventing agent (AS-1), 0.40 g of a green-sensitive silver chloride emulsion (average grain size: 0.45 μm) and 1.85 g of gelatin.

MC-1: 3-[2-Chloro-5-(1-octadecenylsuccinimido)anilino]-1-(2,4,6-trichlorophenyl)-5-pyrazolone.

Layer 4

A second intermediate layer comprising a dispersion of 0.22 g of DBP having dissolved 0.2 g of a UV absorber (UV-1), 0.3 g of a UV absorber (UV-2) and 0.05 g of a color stain preventing agent (AS-1), and 1.45 g of gelatin.

UV-1: 2-(2-Hydroxy-3,5-di-t-butylphenyl)benzotriazole

UV-2: 2-(2-Hydroxy-5-t-butylphenyl)benzotriazole

Layer 5

A red-sensitive emulsion layer comprising a dispersion of 0.3 g of DBP having dissolved 0.42 g of a cyan coupler (CC-1) and 0.005 g of a color stain preventing agent (AS-1), 0.30 g of a red-sensitive silver chloride emulsion (average grain size: 0.40 μm) and 1.6 g of gelatin.

CC-1: 2-[2-(2,4-Di-t-amylphenoxy)butaneamido]-4,6-dichloro-5-methylphenol

Layer 6

A protective layer containing 1.8 g of gelatin.

As mentioned previously, the silver chloride emulsion used in Layer 1 was subjected to chemical ripening according to the same method as in Example 1, and after addition of a stabilizer mixed with an aqueous 10% gelatin solution under stirring, followed by cooling to be set.

The silver halide emulsion used in the Layer 3 was subjected to chemical ripening with $1.5\times10^{-5}$ mole of sodium thiosulfate per mole of silver halide, and prepared in the same manner as in preparation of the emulsion in Layer 1, except for using $3.0\times10^{-4}$ mole of anhydro-5,5'-diphenyl-9-ethyl-3,3'-di-(γ-sulfopropyl-)oxacarbocyanine hydroxide as sensitizing dye.

The silver halide emulsion used in the Layer 5 was prepared in the same manner as in preparation of the emulsion in Layer 3, except for using $3.0\times10^{-4}$ mole of 3,3'-di-(β-hydroxyethyl)-thiadicarbocyanine bromide.

Other than the aforementioned materials, bis(vinylsulfonylmethyl)ether was also incorporated as hardener and saponin as surfactant.

From the sensitizing dye (I-7) alone, Sample 7 was prepared, while Sample 8 from (II-1) and Sample 9 from a combination of (I-7) and (II-1).

Sample 10 was also prepared under entirely the same conditions except for replacing respective emulsion layers with a silver chlorobromide emulsion containing 15 mole % of silver chloride with an average grain size of 0.70 μm (blue-sensitive emulsion layer), a silver chlorobromide emulsion containing 20 mole % of silver chloride with an average grain size of 0.45 μm (green-sensitive emulsion layer), and a silver chlorobromide emulsion containing 20 mole % of silver chloride with an average grain size of 0.40 μm (red-sensitive emulsion layer), respectively. The outline of the samples are shown in Table 2.

TABLE 2

| Sample No. | Amount of sensitizing dye added ($\times 10^{-4}$ mole/mole AgX) | | Halide composition | |
|---|---|---|---|---|
| 7 | (I - 7) | 3.0 | Silver chloride | Control |
| 8 | (II - 1) | 3.0 | Silver chloride | Control |
| 9 | (I - 7) | 1.5 | Silver chloride | This invention |
| 9 | (II - 1) | 1.5 | | |
| 10 | (I - 7) | 3.0 | Silver chlorobromide | Control |

The four kinds of samples were exposed to light through a color negative, and subjected to the process as described in Example 1. In the Sample 10, substantially no image was obtained, especially lacking yellow tint. Accordingly, development conditions were changed by use of a (CD-2) color developer and development time of 3.5 minutes to result in a color print exhibiting good color reproduction and tone reproduction. Samples 7, 8 and 9 all gave fairly good images by one minute development with (CD-1) color developer, but Sample 7 had a drawback of blue-tinted reproduction of green. Also, in Sample 8, there was a drawback of red-tinted reproduction at the higher density portion of yellow color. In Sample 9 of the light-sensitive material according to this invention, no such drawback was found and there was observed no lowering in chroma of red and green at the higher density region as compared with the color print of the prior art (Sample 10). Thus, it would readily be understood that a color photographic paper endowed with excellent quick process suitability as well as excellent color reproducibility can be obtained by the combination of sensitizing dyes according to this invention.

(CD-2) color developer: In the composition of the color developer shown in Example 1 (CD-1) 0.03 g of adenine is changed to 0 g and 0 g of potassium bromide is changed to 0.5 g, and the resultant composition is called as CD-2.

EXAMPLE 3

A silver chloride emulsion with an average grain size of 0.4 μm was subjected in a conventional manner to chemical ripening with $2\times10^{-5}$ mole of sodium thiosulfate per mole of silver halide, and this was divided into 10 aliquots. Then, as shown in the following Table 3, the aforesaid sensitizing dyes (III-12) and (V-11) were added individually or in combinations (the total amount of dyes added was made $3.0\times10^{-4}$ mole per mole of silver halide). After sufficient stirring, a stabilizer (ST-1) was added in an amount of 1 g per mole of silver halide, followed by addition of a dispersion of DBP having dissolved 0.3 mole of a yellow coupler (YC-1) per mole of silver halide and 0.15 mole of a color stain preventing agent (AS-1) per mole of said coupler. On a paper support for photography laminated with a polyethylene containing an anatase type titanium oxide, the above emulsion was coated to coating amounts of 0.35 g/m$^2$ as metallic silver and 3.0 g/m$^2$ of gelatin to provide a protective layer. In the protective layer, bis(vinylsulfonylmethyl)ether was incorporated as hardener and saponin as surfactant.

The thus prepared samples were subjected wedgewise exposure only (Example 1. (a)) and color development and other process according to the same methods as in Example 1.

The reflective densities of the dye images formed in respective samples were measured similarly as in Example 1 to obtain relative sensitivities and fogs. Relative sensitivity was represented, with the sensitivity of Sample 11 as being 100. The results are shown in Table 3.

TABLE 3

| Sample No. | Sensitizing dye ratio (III - 12):(V - 11) | Relative sensitivity | Fog |
|---|---|---|---|
| 11 | All (III - 12) | 100 | 0.05 |
| 12 | 10:1 | 118 | 0.05 |
| 13 | 5:1 | 131 | 0.05 |
| 14 | 2:1 | 137 | 0.05 |
| 15 | 1:1 | 123 | 0.05 |
| 16 | 1:2 | 104 | 0.05 |
| 17 | 1:5 | 87 | 0.06 |
| 18 | 1:10 | 75 | 0.05 |
| 19 | All (V - 11) | 60 | 0.05 |
| 20 | No sensitizing dye | — | 0.06 |

In Samples to which no sensitizing dye was added, no image was formed under the same exposure conditions as used for other samples and no measurement was possible. As apparently seen from Table 3, by use of the combination of the sensitizing dyes according to this invention, particularly in a range of (III-12):(V-11)=5:1 to 1:1, marked supersensitization effect can be obtained. Even in cases of Samples 17, 18 outside said range, the sensitivity is superior over the expected as an average of Samples 11 and 19 individually employed.

EXAMPLE 4

Except for using sensitizing dyes (IV-6) and (V-11), there were prepared samples of blue-sensitive emulsion coating layers according to entirely the same method and conditions as in Example 3, and following also entirely the same procedure as in Example 3, exposure and development process were conducted with the use of these materials. The results are shown in Table 4. The results are shown similarly as in Table 3 with the standard sensitivity of the Sample 21 as 100, in terms of relative sensitivities of other samples relative thereto.

TABLE 4

| Sample No. | Sensitizing dye (IV - 6):(V - 11) | Relative sensitivity | Fog |
|---|---|---|---|
| 21 | All (IV - 6) | 100 | 0.07 |
| 22 | 10:1 | 106 | 0.08 |
| 23 | 5:1 | 112 | 0.07 |
| 24 | 2:1 | 115 | 0.07 |
| 25 | 1:1 | 127 | 0.06 |
| 26 | 1:2 | 130 | 0.06 |
| 27 | 1:5 | 120 | 0.05 |
| 28 | 1:10 | 105 | 0.05 |
| 29 | All (V - 11) | 90 | 0.06 |
| 30 | No sensitizing dye | — | 0.06 |

In the Samples to which no sensitizing dye was added, no image was obtained under the same exposure conditions as employed for other samples and no measurement was possible. The supersensitization effect could be seen especially marked at the range of (IV-6):(V-11)=1:1–1:5.

EXAMPLE 5

Next, for confirmation of how much sensitivity enhancement can be expected by using individually sensitizing dyes, sensitizing dyes (III-12), (IV-6) and (V-11) were added individually in various amounts. Otherwise, following the same procedures as in Example 3, coated samples were prepared and subjected to exposure and development and other process. The results are shown in Table 5. Relative sensitivities were represented with the standard sensitivity of the Sample 34 as 100.

TABLE 5

| Sample No. | Amount of sensitizing dye added ($\times 10^{-4}$ mole/mole AgX) | | Relative sensitivity | Fog |
|---|---|---|---|---|
| 31 | None | | — | 0.05 |
| 32 | (III - 12) | 1.0 | 45 | 0.05 |
| 33 | (III - 12) | 2.0 | 77 | 0.05 |
| 34 | (III - 12) | 3.0 | 100 | 0.06 |
| 35 | (III - 12) | 4.0 | 83 | 0.07 |
| 36 | (IV - 6) | 1.0 | 56 | 0.06 |
| 37 | (IV - 6) | 2.0 | 65 | 0.07 |
| 38 | (IV - 6) | 3.0 | 79 | 0.06 |
| 39 | (IV - 6) | 4.0 | 85 | 0.07 |
| 40 | (IV - 6) | 5.0 | 70 | 0.09 |
| 41 | (V - 11) | 1.0 | 55 | 0.05 |
| 42 | (V - 11) | 2.0 | 78 | 0.06 |
| 43 | (V - 11) | 3.0 | 92 | 0.05 |
| 44 | (V - 11) | 4.0 | 88 | 0.06 |
| 45 | (III - 12)<br>(V - 11) | 2.0<br>1.0 | 142 | 0.06 |
| 46 | (IV - 6)<br>(V - 11) | 1.0<br>2.0 | 131 | 0.05 |

When each sensitizing dye was employed individually, the sensitivity was at its maximum at $3.0\times10^{-4}$ mole for (III-12), $4.0\times10^{-4}$ mole for (IV-6) and $3.0\times10^{-4}$ mole for (V-11) per mole of silver halide, respectively. However, in the samples 45 and 46 of the combinations according to this invention, higher sensitivity was obtained in either case than those when dyes were employed individually.

When $3.0\times10^{-4}$ mole or more per mole of silver halide of (III-12) was added, stain of residual sensitizing dye in color photographic material, although slightly, was observed, and similar stain also observed for (V-11) at $3.0\times10^{-4}$ mole or higher. In contrast, no such stain was observed in Sample 45 employing the combination of sensitizing dyes according to this invention. On the other hand, when the above sensitizing dyes (III-12) and (V-11) were employed both individually in a silver chlorobromide emulsion of the same grain size, while changing the color development with (CD-1) for one minute to the color development with (CD-2) for 3 minutes 30 seconds among the process as described in Example 1, no stain occured due to remaining of dyes. This shows that such a stain is a drawback caused by quick process of higher chloride silver halide, and it will be readily understood that the drawback can be overcome by employment of the combination of the sensitizing dyes according to this invention as described above.

EXAMPLE 6

A silver chloride emulsion with an average grain size of 0.70 μm was sulfur sensitized with $1\times10^{-5}$ mole of sodium thiosulfate per mole of silver halide, divided into aliquots five minutes before termination of ripening, to which sensitizing dye solutions prepared previously were added individually or in combination (see Table 6). On termination of ripening, a stabilizer (ST-1) was added in an amount of 1 g per mole of silver halide to each sample.

Each sample was then coated as a coating solution according to the procedure as in Example 3. Exposure and development were performed all similarly as in Example 3. The results are shown in Table 6. Similarly, relative sensitivities were shown, with the sensitivity of the Sample 48 as being 100.

TABLE 6

| Sample No. | Amount of sensitizing dye added ($\times 10^{-4}$ mole/mole AgX) | | Relative sensitivity | Fog |
|---|---|---|---|---|
| 47 | None | | — | 0.05 |
| 48 | (III - 12) | 3.0 | 100 | 0.05 |
| 49 | (IV - 6) | 3.0 | 90 | 0.06 |
| 50 | (V - 11) | 3.0 | 82 | 0.05 |
| 51 | (III - 12)<br>(V - 11) | 2.0<br>1.0 | 131 | 0.05 |
| 52 | (IV - 6)<br>(V - 11) | 1.0<br>2.0 | 135 | 0.05 |
| 53 | (III - 3) | 3.0 | 115 | 0.06 |
| 54 | (III - 13) | 3.0 | 97 | 0.05 |
| 55 | (III - 3)<br>(V - 11) | 2.0<br>1.0 | 148 | 0.05 |
| 56 | (III - 13)<br>(V - 11) | 1.5<br>1.5 | 125 | 0.06 |
| 57 | (V - 6) | 3.0 | 63 | 0.08 |
| 58 | (III - 12)<br>(V - 6) | 2.0<br>1.0 | 120 | 0.06 |
| 59 | (I - 11) | 3.0 | 79 | 0.06 |
| 60 | (I - 11)<br>(II - 3) | 2.0<br>1.0 | 81 | 0.06 |

Similarly as in Example 3 and Example 4, when the combinations of the sensitizing dyes according to this invention were employed, high sensitivities not realized by use of individual dyes could be exhibited. When the combinations of the dyes (I-11) and (II-3) was applied for a higher chloride silver halide emulsion, a favorable spectral sensitivity distribution could be afforded. However, as can be seen from Table 6, the drawback of lower sensitivity of the higher chloride silver halide emulsion could not be improved to give only insufficient performance.

EXAMPLE 7

Corona discharging treatment was applied on a paper support for photography laminated with a polyethylene containing an anatase type titanium oxide, and the same six layers as in Example 2 were overlayed by coating to prepare a light-sensitive color photographic material for print.

The silver halide emulsion used for Layer 1 was prepared as follows. Chemical ripening was performed after addition of $1\times10^{-5}$ mole of sodium thiosulfate per mole of silver halide emulsion, and a sensitizing dye was added as 0.1% solution 5 minutes before termination of chemical ripening. Five minutes later, on termination of the chemical ripening a stabilizer (ST-1) was added as 0.5% aqueous solution. After addition, 10% aqueous gelatin solution was added, followed by stirring and cooling to be set.

The silver halide emulsions employed in Layer 3 and layer 5 were prepared according to the same method as in Example 2, respectively.

Other than said materials, bis(vinylsulfonylmethyl)ether was incorporated as hardener and saponin as surfactant.

There were prepared Sample 62 by use of the sensitizing dye (III-12) alone, Samples 63, 64 by using the combinations according to this invention, and Sample 61 under the same conditions except for replacing the respective emulsion layers with a silver chlorobromide containing 15 mole % of silver chloride with an average grain size of 0.70 μm (III-12 as sensitizing dye) (blue-sensitive emulsion layer), a silver chlorobromide containing 20 mole % of silver chloride with an average grain size of 0.45 μm (green-sensitive emulsion layer), and a silver chlorobromide containing 20 mole % of silver chloride with an average grain size of 0.4 μm (red-sensitive emulsion layer), respectively.

The sensitizing dyes were added in the blue-sensitive emulsion layers in total amounts of $3.0\times10^{-4}$ mole per mole of silver halide. The dye employed and mixing ratios are shown in Table 7.

TABLE 7

| Sample No. | Kinds of sensitizing dye and mixing ratio | Silver halide | |
|---|---|---|---|
| 61 | (III - 12) | Silver chloro-bromide | Control |
| 62 | (III - 12) | Silver chloride | Control |
| 63 | (III - 12):(V - 11) = 2:1 | Silver chloride | This invention |
| 64 | (IV - 6):(V - 11) = 1:2 | Silver chloride | This invention |

The above four kinds of samples were exposed to light through a color negative, printed and subjected to the process as described in Example 1. The Control sample 61 gave substantially no image, and especially deficient in yellow tint. Accordingly, process with (CD-2) as mentioned in Example 2 was carried out for 3 minutes and 30 seconds to obtain a color print. From both of the light-sensitive materials 63 and 64 according to this invention, color prints were obtained exhibiting good color reproduction and tone reproduction comparable to Control sample 61. Particularly, red, green and yellow colors were not lowered in chroma to higher density regions, whereby it was confirmed that there could be obtained with silver chloride color papers by far superior in color reproduction to those obtained by use of silver chlorobromide of the prior art.

On the other hand, in Control sample 62 employing only one kind of sensitizing dye, while lowering in chroma of red or green at higher sensitivity region was small, the higher density region of yellow was reproduced with red tincture and the red color reproduced with purple tincture.

The light-sensitive materials 63, 64 according to this invention were entirely free from stain by residual sensitizing dye, although the color development was shortened from 3 minutes to 30 seconds of the prior art to one minute.

EXAMPLE 8

A silver chloride emulsion with an average particle size of 0.4 μm was subjected to chemical ripening in a conventional manner with $2\times10^{-5}$ mole of sodium thiosulfate per mole of silver halide, and divided into 10 aliquots. Then, as shown in the following Table 8, sensitizing dyes of (III-12) and (VI-11) were added either individually or in combination (the total amount of dyes added being made $3.0\times10^{-4}$ mole per mole of silver halide). After sufficient stirring, a stabilizer (ST-1) was added in an amount of 1 g per mole of silver halide, followed further by addition of 0.3 mole of a yellow coupler (YC-1) per mole of silver halide and 0.15 mole of a color stain preventing agent (AS-1) per mole of said coupler, which are dispersed at the same time in DBP.

On a paper support for photography laminated with a polyethylene containing an anatase type titanium oxide, the above emulsions were applied to coating amounts of 0.35 g/m$^2$ as metallic silver and 3.0 g/m$^2$ of gelatin to provide a protective layer. In said protective layer, bis(vinylsulfonylmethyl)ether was added as hardener and saponin as surfactant. The thus prepared samples were exposed and then subjected to color development and other process similarly as described in Example 3.

The reflective densities of dye images formed in respective samples were measured by the same method as in Example 3 to obtain relative sensitivities and fogs. Relative sensitivity was represented relative to the sensitivity of Sample 65 as 100.

TABLE 8

| Sample No. | Sensitizing dye ratio (III - 6):(VI - 1) | Relative sensitivity | Fog |
|---|---|---|---|
| 65 | All (III - 6) | 100 | 0.05 |
| 66 | 10:1 | 112 | 0.05 |
| 67 | 5:1 | 119 | 0.05 |
| 68 | 2:1 | 131 | 0.04 |
| 69 | 1:1 | 134 | 0.05 |
| 70 | 1:2 | 105 | 0.06 |
| 71 | 1:5 | 86 | 0.05 |
| 72 | 1:10 | 74 | 0.06 |
| 73 | All (VI - 1) | 51 | 0.06 |
| 74 | No sensitizing dye | — | 0.05 |

The sample containing no sensitizing dye gave no image under the same exposure conditions for other samples, and measurement of sensitivity was impossible. As apparently seen from Table 8, the combination of sensitizing dyes exhibits markedly its effect in the range of (III-6): (VI-1)=2:1~1:1. Even outside said range [(III-6):(VI-1)=10:1~1:2], it effect can be seen clearly, and in other ranges its performance is by superior to that as expected from the average value of the sensitivities when the samples were employed individually.

EXAMPLE 9

A silver chloride emulsion with an average grain size of 0.70 μm was sulfur sensitized with $1\times10^{-5}$ mole of sodium thiosulfate per mole of silver halide, dividied into aliquots five minutes before termination of ripening to which sensitizing dye solutions prepared previously were added individually or in combination (see Table 9). On termination of ripening, a stabilizer (ST-1) was added in an amount of 1 g per mole of silver halide to each sample. Each sample was then made into a coating solution and coating according to the procedure as in Example 1. Exposure and development were performed all similarly as in Example 3. The results are shown in Table 9. Sensitivities were shown, with the relative sensitivity of the Sample 76 as being 100.

TABLE 9

| Sample No. | Amount of sensitizing dye added ($\times 10^{-4}$ mole/mole AgX) | | Relative sensitivity | Fog |
|---|---|---|---|---|
| 75 | No sensitizing dye | | — | 0.05 |
| 76 | (III - 6) | 3.0 | 100 | 0.05 |
| 77 | (III - 12) | 3.0 | 102 | 0.06 |
| 78 | (IV - 6) | 4.0 | 92 | 0.05 |
| 79 | (VI - 1) | 3.0 | 70 | 0.08 |
| 80 | (VI - 6) | 3.0 | 56 | 0.04 |
| | (III - 6) | 1.5 | | |

TABLE 9-continued

| Sample No. | Amount of sensitizing dye added ($\times 10^{-4}$ mole/mole AgX) | | Relative sensitivity | Fog |
|---|---|---|---|---|
| 81 | (VI - 1) | 1.5 | 130 | 0.07 |
| 82 | (III - 6)<br>(VI - 6) | 2.0<br>1.0 | 124 | 0.06 |
| 83 | (III - 12)<br>(VI - 1) | 1.5<br>1.5 | 135 | 0.07 |
| 84 | (IV - 6)<br>(VI - 1) | 2.0<br>1.0 | 124 | 0.05 |
| 85 | (III - 3) | 3.0 | 121 | 0.06 |
| 86 | (IV - 9) | 3.0 | 67 | 0.06 |
| 87 | (III - 13)<br>(VI - 1) | 2.0<br>1.0 | 145 | 0.06 |
| 88 | (IV - 9)<br>(VI - 1) | 1.5<br>1.5 | 110 | 0.05 |
| 89 | (I - 11) | 3.0 | 79 | 0.06 |
| 90 | (I - 11)<br>(II - 3) | 2.0<br>1.0 | 82 | 0.06 |

Similarly as in Example 8, when the combinations of the sensitizing dyes according to this invention were employed, high sensitivities not realized by use of individual dyes could be exhibited. When the combinations of the dyes (I-11) and (II-3) was applied for a higher chloride silver halide emulsion, a favorable spectral sensitivity distribution could be afforded. However, as can be seen from Table 9, the drawback of lower sensitivity to higher chloride silver halide emulsion could not be improved to give only insufficient performance.

EXAMPLE 10

Sensitizing dyes (III-6), (IV-6) and (VI-1) were added individually in various amounts. Otherwise, following the same procedures as in Example 3, coated samples were prepared and subjected to exposure and development and other process. The results are shown in Table 10. Relative sensitivities were represented with the standard sensitivity of the Sample 94 as 100.

TABLE 10

| Sample No. | Amount of sensitizing dye added ($\times 10^{-4}$ mole/mole AgX) | | Relative sensitivity | Fog |
|---|---|---|---|---|
| 91 | No sensitizing dye | | — | 0.05 |
| 92 | (III - 6) | 1.0 | 58 | 0.05 |
| 93 | (III - 6) | 2.0 | 79 | 0.05 |
| 94 | (III - 6) | 3.0 | 100 | 0.05 |
| 95 | (III - 6) | 4.0 | 96 | 0.05 |
| 96 | (IV - 6) | 1.0 | 53 | 0.05 |
| 97 | (IV - 6) | 2.0 | 62 | 0.05 |
| 98 | (IV - 6) | 3.0 | 76 | 0.05 |
| 99 | (IV - 6) | 4.0 | 90 | 0.06 |
| 100 | (IV - 6) | 5.0 | 81 | 0.07 |
| 101 | (VI - 1) | 1.0 | 19 | 0.06 |
| 102 | (VI - 1) | 2.0 | 32 | 0.08 |
| 103 | (VI - 1) | 3.0 | 50 | 0.08 |
| 104 | (VI - 1) | 4.0 | 52 | 0.11 |
| 105 | (III - 6)<br>(VI - 1) | 1.5<br>1.5 | 140 | 0.07 |
| 106 | (IV - 6)<br>(VI - 1) | 1.5<br>1.5 | 109 | 0.08 |

When each sensitizing dye was employed individually, the sensitivity was at its maximum at $3.0\times10^{-4}$ mole for (III-6), $4.0\times10^{-4}$ mole for (IV-6) and $4.0\times10^{-4}$ mole for (VI-1) per mole of silver halide, respectively. However, any one of them is inferior in sensitivity to the combinations according to this invention, as can be seen from Table 10.

When $3.0\times10^{-4}$ mole or more per mole of silver halide of (III-6) was added, stain of residual sensitizing dye in photographic material, although slightly, was observed, and similar stain also observed for (VI-1) at $3.0\times10^{-4}$ mole or more. In contrast, no such contamination was observed in Sample 105 employing the combination of sensitizing dyes according to this invention. On the other hand, when the above sensitizing dyes (III-6) and (VI-1) were employed both individually in a silver chlorobromide emulsion of the same grain size, while changing, the color development with (CD-1) for one minute to the color development with (CD-2) for 3 minutes and 30 seconds. In the 3 minutes and 30 seconds process, no stain occurred due to remaining of dyes. This shows that such a stain is a drawback caused by quick process of higher chloride silver halide, and it will be readily understood that the drawback can be overcome by employment of the combination of the sensitizing dyes according to this invention as described above.

EXAMPLE 11

Corona discharging treatment was applied on a paper support for photography laminated with a polyethylene containing an anatase type titanium oxide, and the same six layers as in Example 2 were overlayed by coating to prepare a light-sensitive color photographic material for print (color photographic paper).

The silver halide emulsions employed in Layer 1, Layer 3 and Layer 5 were prepared according to the same method as in Example 2, respectively.

Other than said materials, bis(vinylsulfonylmethyl)ether was incorporated as hardener and saponin as surfactant.

There were prepared Sample 108 by use of the sensitizing dye (III-12) alone, Samples 109, 110 by using the combinations according to this invention, and Sample 107 under the same conditions except for replacing the respective emulsion layers with a silver chlorobromide containing 15 mole % of silver chloride with an average grain size of 0.70 μm (III-12 as sensitizing dye) (blue-sensitive emulsion layer), a silver chlorobromide containing 20 mole % of silver chloride with an average grain size of 0.45 μm (green-sensitive emulsion layer), and a silver chlorobromide containing 20 mole % of silver chloride with an average grain size of 0.4 μm (red-sensitive emulsion layer), respectively.

The sensitizing dyes were added in the blue-sensitive emulsion layers in total amounts of $3.0\times10^{-4}$ mole/mole AgX. The dye employed and mixing ratios are shown in Table 11.

TABLE 11

| Sample No. | Kinds of sensitizing dye and mixing ratio | Silver halide | |
|---|---|---|---|
| 107 | (III - 12) | Silver chlorobromide | Control |
| 108 | (III - 12) | Silver chloride | Control |
| 109 | (III - 12):(VI - 1) = 1:1 | Silver chloride | This invention |
| 110 | (IV - 6):(VI - 1) = 2:1 | Silver chloride | This invention |

The above four kinds of samples were exposed to light through a color negative, printed and processed as described in Example 1. The Control sample 107 gave substantially no image, and especially deficient in yellow tint. Accordingly, treatment with (CD-2) as mentioned in Example 2 was carried out for 3 minutes and 30 seconds to obtain a color print. From both of the light-sensitive materials 109 and 110 according to this invention, color prints were obtained exhibiting good color reproduction and tone reproduction comparable to Control sample 107. Particularly, red, green and yellow colors were not lowered in chroma to higher density regions, whereby it was confirmed that there could be obtained with silver chloride color photographic papers by far superior in color reproduction to those obtained by use of silver chlorobromide of the prior art.

On the other hand, in Control sample 108 employing only one kind of sensitizing dye, while lowering in chroma of red or green at higher sensitivity region was small, the higher density region of yellow was reproduced with red tincture and the red color reproduced with purple tincture.

The light-sensitive materials 109, 110 according to this invention were entirely free from stain by residual dye, although the color development was shortened from 3 minutes 30 seconds of the prior art to one minute.

As described above, it would readily be understood how useful is the combination of the sensitizing dyes according to this invention in quick process suitability and excellent color reproducibility as a characteristic of a light-sensitive color photographic material.

We claim:

1. A light-sensitive silver halide color photographic material comprising at least one layer having a negative working silver halide on a support, said negative working silver halide comprising at least 80 mole % of silver chloride and being spectrally sensitized with a first sensitizing dye having a local maximum value of spectral sensitivity in the wavelength region of from 445 nm to 490 nm, said first sensitizing dye being at least one sensitizing dye of formula (III) or (IV):

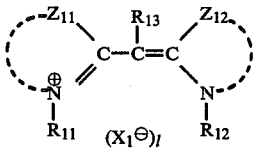

Formula [III]

wherein $Z_{11}$ and $Z_{12}$ are each the atoms necessary for the formation of a group selected from the group consisting of a benzoxazole nucleus, a naphthoxazole nucleus, a benzothiazole nucleus, a napthothiazole nucleus, a benzoselenazole nucleus, a naphthoselenazole nucleus, a benzimidazole nucleus, a naphthoimidazole nucleus, a pyridine nucleus and a quinoline nucleus, said groups may be subsituted with a substituent selected from the group consisting of halogen, hydroxy, cyano, aryl, alkyl, alkoxy, and alkoxycarbonyl; $R_{11}$ and $R_{12}$ are each selected from the group consisting of an alkyl group, a substituted alkyl group wherein the substituents are selected from the group consisting of a carboxy group and a sulfo group; an alkenyl group and an aryl group; $R_{13}$ is selected from the group consisting of a hydrogen atom, a methyl group and an ethyl group; $X_1\ominus$ is an anion; and l is 0 or 1,

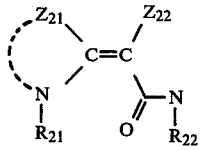

Formula [IV]

wherein $Z_{21}$ represents the atoms necessary for the formation of a group selected from the group consisting of a benzoxazole nucleus, a naphthoxazole nucleus, a benzothiazole nucleus, a naphthothiazole nucleus, a benzoselenazole nucleus, a naphthoselenazole nucleus, a benzimidazole nucleus and a naphthoimidazole nucleus, said groups may be substituted with a substituent selected from the group consisting of halogen, hydroxy, cyano, aryl, alkyl, alkoxy, and alkoxycarbonyl; $Z_{22}$ represents the atoms necessary for formation of a group selected from the group consisting of a rhodanine nucleus, a 2-thiodantoin nucleus which may be substituted at the 1-position with a substituent selected from the group consisting of alkyl, hydroxyalkyl and alkoxycarbonyl, and a 2-thioselenazolidine-2,4-dione nucleus; $R_{21}$ and $R_{22}$ are each selected from the group consisting of an alkyl group, an alkenyl group and an aryl group, said groups for $R_{21}$ and $R_{22}$ may be substituted with a substituent selected from the group consisting of alkyl, aryl, sulfoalkyl, carboxyalkyl, aralkyl, alkoxyalkyl, and alkoxycarbonylalkyl;

and a second sensitizing dye having a local maximum value of spectral sensitivity in the wavelength region from 420 nm to less than 445 nm, said second sensitizing dye being at least one sensitizing dye of formula (V) or (VI):

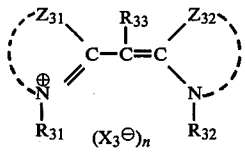

Formula [V]

wherein $Z_{31}$ and $Z_{32}$ are each the atoms necessary for formation of a cyanine heterocyclic nucleus selected from the group consisting of Group A and Group B wherein $Z_{31}$ and $Z_{32}$ may both be selected from Group A, and wherein $Z_{31}$ and $Z_{32}$ cannot both be selected from Group B; said cyanine heterocyclic nucleus of Group A being selected from the group consisting of an imidazole nucleus, an oxazole nucleus, a thiazole nucleus, a selenazole nucleus, and an indole nucleus; and said cyanine heterocyclic nucleus of Group B being selected from the group consisting of a benzimidazole nucleus, a naphthoimidazole nucleus, a benzoxazole nucleus, a naphthoxazole nucleus, a benzothiazole nucleus, a naphthothiazole nucleus, a benzoselenazole nucleus, a naphthoselenazole nucleus, a pyridine nucleus, and a quinoline nucleus, said groups of Group A and Group B may be substituted with a substituent selected from the group consisting of halogen, hydroxy, cyano, aryl, alkyl, alkoxy, and alkoxycarbonyl; $R_{31}$ and $R_{32}$ are each selected from the group consisting of an alkyl group, an alkenyl group and an aryl group, said alkyl group may be substituted with a substituent selected from the group consisting of carboxy and sulfo; $R_{33}$ is selected from the group consisting of a hydrogen atom, methyl group and an ethyl group; $X_3\ominus$ is an anion; and n is 0 or 1:

Formula [VI]

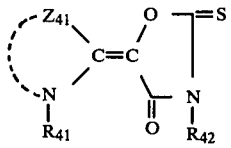

wherein $Z_{41}$ is the atoms necessary for formation of a group selected from the group consisting of a benzothiazole nucleus, a naphthothiazole nucleus, a benzoselenazole nucleus and a naphthoselenazole nucleus, said groups may be substituted with a substituent selected from the group consisting of halogen, hydroxy, cyano, aryl, alkyl, alkoxy and alkoxycarbonyl; $R_{41}$ and $R_{42}$ are each selected from the group consisting of an alkyl group, an alkenyl group an aryl group, said groups for $R_{41}$ and $R_{42}$ may be substituted with a substituent selected from the group consisting of alkyl, aryl, sulfoalkyl, carboxyalkyl, aralkyl, alkoxyalkyl, and alkoxycarbonylalkyl;

provided that when said first sensitizing dye is selected from compounds of formula (III) said second sensitizing dye is selected from compounds of formula (VI).

2. The photographic material of claim 1, wherein said first and second sensitizing dyes are present in an amount of $2\times10^{-6}$ mole to $1\times10^{-3}$ mole per mole of silver halide.

3. The photographic material of claim 1, wherein the molar ratio of said first sensitizing dye to said second sensitizing dye is between 20 and 0.05.

4. The photographic material of claim 1, wherein said second sensitizing dye is at least one sensitizing dye represented by formula (V-b) and said first sensitizing dye is at least one sensitizing dye represented by formula (IV-c):

Formula [V-b]

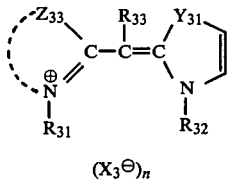

wherein $Z_{33}$ is the atoms necessary for the formation of a group selected from the group consisting of a benzoxazole nucleus, a naphthoxazole nucleus, a benzothiazole nucleus, a naphthothiazole nucleus, a benzoselenazole nucleus, a naphthoselenazole nucleus, a pyridine nucleus and a quinoline nucleus; $Y_{31}$ is selected from the group consisting of an oxygen atom, a sulfur atom and a selenium atom; $R_{31}$ and $R_{32}$ are each selected from the group consisting of an alkyl group, an alkenyl group and an aryl group; $R_{33}$ is selected from the group consisting of a hydrogen atom, a methyl group and an ethyl group; $X_3\ominus$ is an anion and n is 0 or 1, Formula [IV-c]

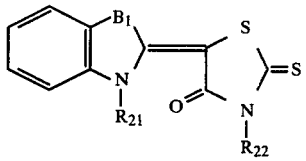

wherein $B_1$ is selected from the group consisting of an oxygen atom, a sulfur atom and a selenium atom; and $R_{21}$ and $R_{22}$ are each selected from the group consisting of an alkyl group, an alkenyl group and an aryl group.

5. The photographic material of claim 4, wherein $Z_{33}$ is the atoms necessary for the formation of a group selected from the group consisting of a benzothiazole nucleus, a naphthothiazole nucleus, a benzoselenazole nucleus and a naphthoselenazole nucleus and $Y_{31}$ is selected from the group consisting of a sulfur atom and a selenium atom.

6. The photographic material of claim 1, wherein said second sensitizing dye is at least one sensitizing dye of formula (VI) and said first sensitizing dye is at least one sensitizing dye of formula (III).

7. The photographic material of claim 6, wherein said first sensitizing dye is at least one of sensitizing dye of formula (III-c):

Formula [III-c]

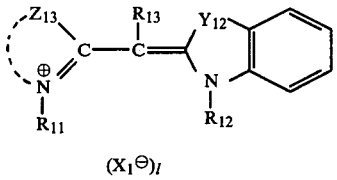

wherein $Z_{13}$ is the atoms necessary for the formation of a group selected from the group consisting of a benzothiazole nucleus, a benzoselenazole nucleus, a naphthothiazole nucleus and a naphthoselenazole nucleus; $Y_{12}$ is selected from the group consisting of a sulfur atom and a selenium atom; $R_{11}$ and $R_{12}$ are each selected from the group consisting of an alkyl group, an alkenyl group and an aryl group; $R_{13}$ is selected from the group consisting of a hydrogen atom, a methyl group and an ethyl group; $X_1\ominus$ is an anion; and n is 0 or 1.

8. The photographic material of claim 7, wherein $Z_{13}$ is the atoms necessary for formation of a group selected from the group consisting of a benzothiazole nucleus and a benzoselenazole nucleus.

9. The photographic material of claim 1, wherein said first sensitizing dye is at least one sensitizing dye of formula (III-b'):

Formula [III-b']

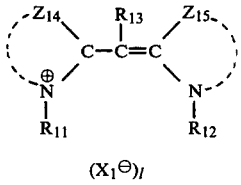

wherein $Z_{14}$ and $Z_{15}$ are each the atoms necessary for formation of a group selected from the group consisting of naphthothiazole nucleus and a naphthoselenazole nucleus; $R_{11}$ and $R_{12}$ are each selected from the group consisting of an alkyl group, an alkenyl group and an aryl group; $R_{13}$ is selected from the group consisting of a hydrogen atom, a methyl group and an ethyl group; $X_1^{\ominus}$ is an anion; and n is 0 or 1.

10. The photographic material of claim 9, wherein said second sensitizing dye is at least one sensitizing dye of formula (VI) and said first sensitizing dye is at least one sensitizing dye of formula (III-b').

11. The photographic material of claim 1, wherein said second sensitizing dye is at least one sensitizing dye of formula (VI) and said first sensitizing dye is at least one sensitizing dye of formula (IV-c):

Formula [IV-c]

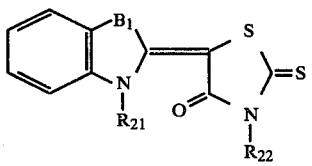

wherein $B_1$ is selected from the group consisting of an oxygen atom, a sulfur atom and a selenium atom; and $R_{21}$ and $R_{22}$ are each selected from the group consisting of an alkyl group, an alkenyl group and an aryl group.

12. The photographic material of claim 1, further comprising a yellow coupler.

13. The photographic material of claim 12, wherein at least one of said layers containing said negative working silver halide is a blue-sensitive emulsion layer containing said yellow coupler.

14. The photographic material of claim 13, which comprises in order a blue-sensitive emulsion layer containing a yellow coupler, a green-sensitive emulsion layer containing a magenta coupler, and a red-sensitive emulsion layer containing a cyan coupler, said blue-sensitive emulsion layer being nearest said support and said red-sensitive emulsion layer being furthest from said support.

15. The photographic material of claim 1, wherein said silver halide comprises at least 90 mole % of silver chloride.

16. The photographic material of claim 1, wherein the molar ratio of said first sensitizing dye to said second sensitizing dye is between 1:10 and 10:1.

17. The photographic material of claim 1, wherein said second sensitizing dye is at least one sensitizing dye of the formula (VI-a):

Formula [VI-a]

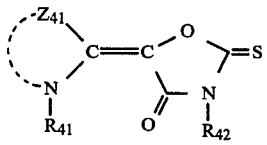

wherein $Z_{41}$ is the atoms necessary for the formation of a group selected from the group consisting of a benzothiazole nucleus, a naphthothiazole nucleus, a benzoselenazole nucleus and a naphthoselenazole nucleus, said groups may be substituted with a substituent selected from the group consisting of halogen, hydroxy, cyano, aryl, alkyl, alkoxy and alkoxycarbonyl; $R_{41}$ and $R_{42}$ are each selected from the group consisting of an alkyl group, an alkenyl group and an aryl group, said groups for $R_{41}$ and $R_{42}$ may be substituted with a substituent selected from the group consisting of alkyl, aryl, sulfoalkyl, carboxyalkyl, aralkyl, alkoxyalkyl, and alkoxycarbonylalkyl.

* * * * *